US006070976A

United States Patent [19]

Takagi et al.

[11] Patent Number: 6,070,976

[45] **Date of Patent: *Jun. 6, 2000**

[54] INK TANK AND RECORDING APPARATUS

[75] Inventors: Jun Takagi; Katsuhide Ogawa; Katsuyuki Fujii; Kazuyuki Oda; Junichi Yoshida; Koji Suenaga, all of Ebina, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/923,005

[22] Filed: Sep. 16, 1997

Related U.S. Application Data

[63] Continuation-in-part of application No. 08/628,884, Apr. 5, 1996, Pat. No. 5,984,460.

[30] Foreign Application Priority Data

Sep. 20, 1996 [JP] Japan ..... 8-250307

[51] Int. Cl.[7] ..... B41J 2/175

[52] U.S. Cl. ..... 347/86

[58] Field of Search ..... 347/84, 85, 86, 347/87, 7

[56] References Cited

U.S. PATENT DOCUMENTS

| | | | |
|---|---|---|---|
| 4,771,295 | 9/1988 | Baker et al. | 347/87 |
| 5,025,271 | 6/1991 | Baker et al. | 347/87 |
| 5,221,148 | 6/1993 | Suzuki et al. | 400/124.1 |
| 5,557,310 | 9/1996 | Kurata et al. | 347/87 |
| 5,633,666 | 5/1997 | Haigo | 347/86 |
| 5,760,806 | 6/1998 | Oda et al. | 347/87 |
| 5,844,578 | 12/1998 | Mochizuki et al. | 347/7 |

FOREIGN PATENT DOCUMENTS

| | | |
|---|---|---|
| 60-245560 | 12/1985 | Japan . |
| 63-87242 | 4/1988 | Japan . |
| B2 5-23954 | 4/1993 | Japan . |
| 6-15837 | 1/1994 | Japan . |
| 7-32063 | 2/1995 | Japan . |
| 7-314712 | 12/1995 | Japan . |
| 7-329313 | 12/1995 | Japan . |
| 8-39821 | 2/1996 | Japan . |

*Primary Examiner*—N. Le
*Assistant Examiner*—Anh T. N. Vo
*Attorney, Agent, or Firm*—Oliff & Berridge, PLC

[57] ABSTRACT

In an ink tank, there are provided a main ink chamber containing a capillary vessel member, and an intermediate ink chamber. When the ink is consumed, the ink held by capillary force of a capillary vessel member is supplied via a communication port from a joint port. The same amount of air as the amount of the consumed ink is conducted from the atmospheric communication port into the main ink chamber. The conducted air is supplied via a groove formed in a lid to an upper surface of the capillary vessel member. As a result, the air is entered into the capillary vessel member under better condition. In a plane portion of the lid, the ink is in contact with only the capillary vessel member, and the ink remaining this portion is reduced. Thus, the ink using efficiency is increased.

43 Claims, 21 Drawing Sheets

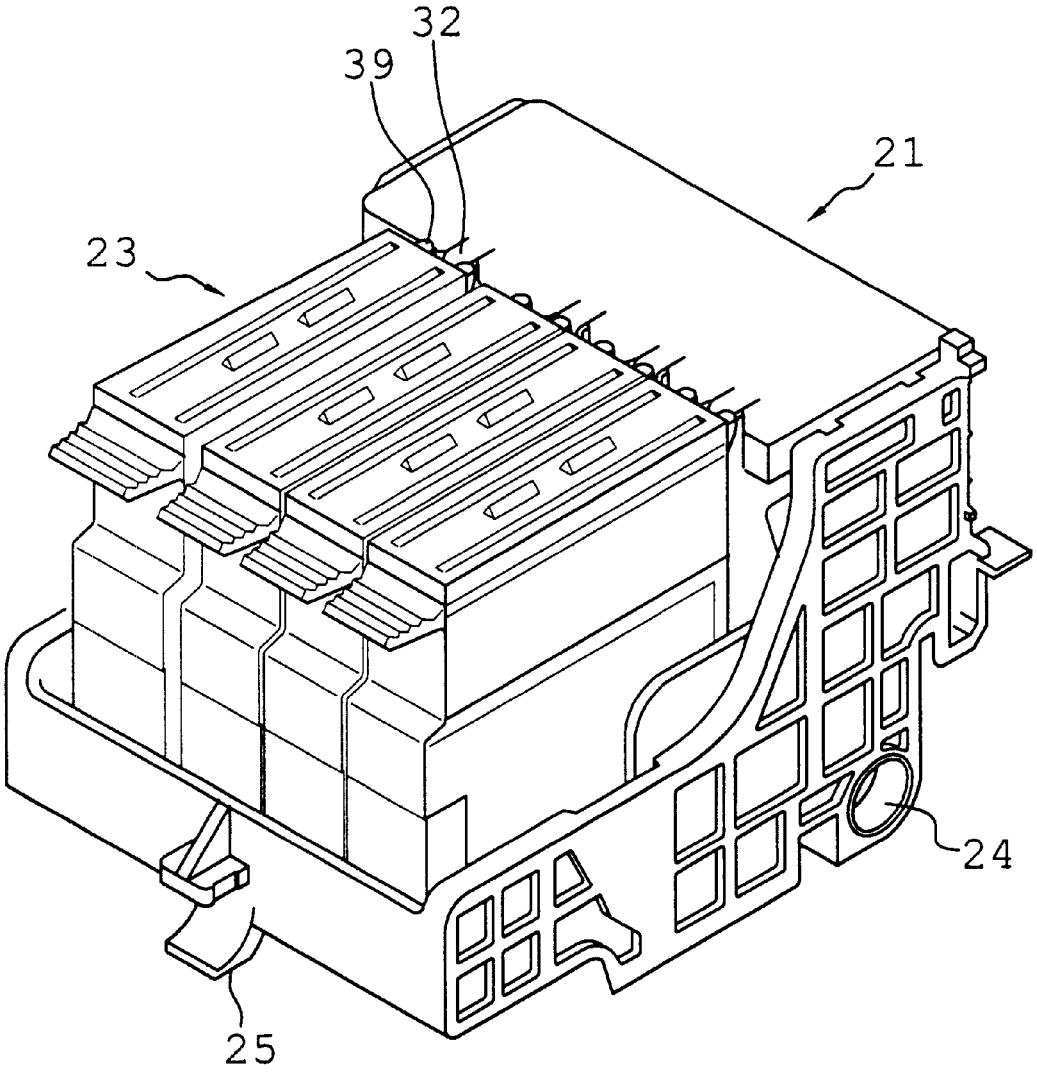
Fig. 19
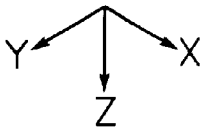

INK TANK AND RECORDING APPARATUS

This is a Continuation-in-Part of application Ser. No. 08/628,884, filed Apr. 5, 1996 U.S. Pat. No. 5,984,460.

BACKGROUND OF THE INVENTION

The present invention relates to an ink tank for supplying ink to a print head, and to a recording apparatus with employment of this ink tank.

Conventionally, as the ink supply mechanism employed in the recording apparatus for recording by ink, as described in, for example, Japanese Laid-open Patent Application No. 63-87242, and U.S. Pat. No. 5,025,271, such an ink supply mechanism has been proposed that the porous member is arranged within the ink tank, one end of this porous member is coupled via the filter to the print head, and the other end thereof is provided with the air intake port. In the ink supply mechanism described in this publication, compression force is given to the foam corresponding to the porous member within the vessel by the tab. However, such an arrangement has a problem that the capillary force of the foam would be increased at the depression unit of the foam by the tab, and the ink may readily remain in the foam. Also, there is a design limitation such that to apply the proper compression force, the above-described arrangement could not be realized unless the ink dipped member per se is the elastic member.

Another conventional technique is described in, for instance, Japanese Patent Publication No. 5-23954. That is, in this ink tank, the projection portion is formed which constitutes the space between the inner wall surface of the ink tank and the ink dipped member. Furthermore, this ink tank owns the means for communicating this space with the atmosphere. However, when the space is formed by the projection unit, the capillary vessel force of the ink dipped member would be similarly increased at the contact point between the projection unit and the ink dipped member. Thus, there is another problem that the ink may readily remain in the ink dipped member.

Furthermore, Japanese Laid-open Patent Application No. 6-15837 discloses the means having the projection portion around the atmospheric communication port in order that the ink does not dip into the atmospheric communication port. However, also in this case, the capillary vessel force of the porous member would be increased at the contact point between the projection portion and the ink-dipped porous member. Thus, there is a problem that the ink may readily remain in the porous material. Moreover, the porous member concaving with the projection portion may easily form the unwanted space between the inner wall surface of the ink tank and therewith. Accordingly, there is a risk to release negative pressure in the ink tank.

Further, the present invention relates to an ink tank which has an atmospheric communication hole and introduces air into the tank, and to an ink-jet recorder equipped with this ink tank.

In an ink-jet recorder, ink is stored in an ink tank, and the ink is supplied to a head corresponding to the amount of ink consumed by recording. The ink tank introduces air into the tank corresponding to the amount of ink supplied to the head through an atmospheric communication hole to thereby regulate an ink pressure to be exerted on the head. In the case of an atmospheric communication hole formed simply in a plane plate, in the event of physical shock or changes in environmental changes, ink seeps from an ink-impregnated member which holds ink inside the ink tank, and the thus-seeped ink leaks out of the ink tank through the atmospheric communication hole.

One example of the construction of an existing ink tank is proposed in, e.g., the Unexamined Japanese Patent Application Publication No. Hei 7-32063. In this ink tank, ink is held by an ink-impregnated member, and a rib is formed in the ink tank in order to prevent the ink-impregnated member from directly entering the atmospheric communication hole, so that an air layer is eventually formed above the ink-impregnated member.

However, the ink tank having the foregoing construction encounters another problem, i.e., the seeping of the ink from the atmospheric communication hole after having splashed into the air layer around the ink-impregnated member. For this reason, the amount of ink to be filled in the tank cannot be increased. Further, since the ink-impregnated member is pressed by the rib, the density of the thus-pressed area of the ink-impregnated member increases, so that ink remains in that area. As a result, it becomes impossible to fully use out the ink held by the ink-impregnated member. Moreover, in order to prevent the ink-impregnated member from directly entering the atmospheric communication channel, a large air layer becomes necessary, which in turn hinders the effective utilization of the inside of the ink tank and results in an increase in the size of the ink tank or a reduction in the amount of ink to be filled.

A communication plate which forms a plurality of cavities disclosed in the Unexamined Japanese Patent Application Publication No. Hei 8-39821 is attached to the outside of an ink tank in order to prevent the leakage of ink and the mixing of colors. The communication plate attached to the outside of the ink tank makes the ink tank bulky correspondingly. Further, since an ink-impregnated member is supported by a rib in the ink tank, space must be ensured above the ink-impregnated member, making it difficult to reduce the size of the ink tank.

SUMMARY OF THE INVENTION

The present invention has been made in an attempt to solve the above-described problems, and therefore, has an object to provide an ink tank capable of increasing an ink using efficiency, and a recording apparatus with employment of this ink tank.

The invention as recited in aspect 1 is characterized by that in an ink tank connected to a print head, a concave communicated to an atmospheric communication hole is formed in an inner wall surface for storing therein a capillary vessel member build in the ink tank; and a space to which air communicates is formed between the concave and the inner wall of the ink tank.

The invention, as recited in aspect 2, is characterized by that in an ink tank connected to a print head, a concave communicated to an atmospheric communication hole is formed on the side of a capillary vessel member build in the ink tank; and a space to which air communicates is formed between the concave and the inner wall of the ink tank.

The invention, as recited in aspect 3, is characterized by that in an ink tank connected to a print head, the ink tank is comprised of:

an ink chamber capable of reservoiring therein the ink;

a communication port provided at a portion of the ink chamber, for conducting the ink reservoired in the ink chamber;

an atmospheric communication port provided at a portion of a wall of the ink chamber, communicated with an external atmosphere, and for supplying the external atmosphere to an inside of the ink chamber; and a capillary vessel member stored within the ink chamber, capable of dipping the ink; wherein:

a concave is formed in a peripheral surface containing the atmospheric communication port within the wall of the ink chamber; and the atmospheric communication port is isolated from the capillary vessel member by way of an air layer existing in the concave.

The invention, as recited in aspect 4, is characterized by that in the ink tank as in aspect 3, a portion of the peripheral surface of the ink chamber containing the atmospheric communication port except the concave portion does not compress the capillary vessel member.

The invention, as recited in aspect 5, is characterized by that in the ink tank as in aspect 3, a compression degree of the capillary vessel member near the atmospheric communication port is lower than, or equal to a compression degree of the capillary vessel member near a center portion thereof.

The invention, as recited in aspect 6, is characterized by that in the ink tank as in aspect 3, the concave is provided at a portion of a surface located opposite to such a surface where the communication port of the ink chamber is formed.

The invention, as recited in aspect 7, is characterized by that in the ink tank as in aspect 3, the atmospheric communication port is provided on an upper surface of the ink chamber; and the concave provided around of the atmospheric communication port is a groove formed along a longitudinal direction of the ink chamber.

The invention, as recited in aspect 8, is characterized by that in the ink tank as in aspect 3, an area of the concave is equal to an approximately half of an area of the surface where the atmospheric communication port of the ink chamber.

The invention, as recited in aspect 9, is characterized by that in the ink tank for supplying ink to a print head, the ink tank is comprised of:

a capillary vessel member capable of dipping ink;

a lid in which an atmospheric communication port for supplying atmosphere, and a groove is formed around the atmospheric communication port of one surface thereof; and an ink chamber for holding the capillary vessel member therein, where a communication port for conducting the ink is provided in a lower portion thereof, and the groove is mounted in such a manner that a surface containing the groove provided on the lid is located inside; wherein:

the atmospheric communication port is isolated from the capillary vessel member by an air layer existing in the groove, while being in contact with the capillary vessel member at a portion of the surface containing the groove of the lid other than the groove.

The invention, as recited in aspect 10, is characterized by that in the ink tank as in aspect 9, the capillary vessel member is not compressed by a portion of the opposite surface of the lid other than the groove.

The invention, as recited in aspect 11, is characterized by that in the ink tank as in aspect 9, a compression degree of the capillary vessel member near the atmospheric communication port is lower than, or equal to a compression degree of the capillary vessel member near a center portion thereof.

The invention, as recited in aspect 12, is characterized by that in an ink tank for supplying ink to a print head, the ink tank is comprised of:

an ink chamber capable of reservoiring therein the ink;

a communication port provided at a portion of the ink chamber, for conducting the ink reservoired in the ink chamber;

an atmospheric communication port provided at a portion of a wall of the ink chamber, communicated with an external atmosphere, and for supplying the external atmosphere to an inside of the ink chamber; and a capillary vessel member stored within the ink chamber, capable of dipping the ink; wherein:

a concave is formed in a peripheral surface containing the atmospheric communication port within the wall of the ink chamber; and the atmospheric communication port is isolated from the capillary vessel member by way of an air layer existing in the concave.

The invention, as recited in aspect 13, is characterized by that in the ink tank as in aspect 12, the wall in which the atmospheric communication hole is a portion of a lid.

The invention, as recited in aspect 14, is characterized by that in the ink tank as in aspect 12, or 13, the surface having the concave of the capillary vessel member is not compressed by the surface of the opposite wall.

The invention, as recited in aspect 15, is characterized by that in the ink tank as in aspect 12, or 13, a compression degree of the capillary vessel member near the atmospheric communication port is lower than, or equal to a compression degree of the capillary vessel member near a center portion thereof.

The invention, as recited in aspect 16, is characterized by that in the ink tank as in any one of the preceding aspects 1 to 15, the ink tank includes a meniscus forming member formed on the communication port, arranged in contact with the capillary vessel member, and in which a plurality of very small holes are formed.

The invention, as recited in aspect 17, is characterized by that in the ink tank as in aspect 16, the ink tank further comprises:

an intermediate ink chamber corresponding to a small chamber under highly sealing condition; and a communication path communicated to the communication port of the ink chamber, the intermediate ink chamber, and the print head.

The invention, as recited in aspect 18, is characterized by that in the ink tank as in any one of the preceding aspects 1–17, the capillary vessel member is a porous material.

The invention, as recited in aspect 19, is characterized by that in the ink tank as in any one of the preceding aspects 1–17, the capillary vessel member is a three-dimensionally branched filaments.

The invention, as recited in aspect 20, is characterized by that in the ink tank as in any one of the preceding aspects 1–17 wherein:

the capillary vessel member is a material spun in a three-dimensional shape.

The invention, as recited in aspect 21, is characterized by that in the ink tank as in any one of the preceding aspects 1–17, the capillary vessel member is a bundled fiber material.

The invention, as recited in aspect 22, is featured by a recording apparatus characterized by employing the ink tank as in any one of the preceding aspects 1 to 21.

According to the invention as recited in aspects 1 and 2, since the concave communicated to the atmosphere is provided, this concave causes the space through which the air passes to be formed between the inner wall of the ink tank and the concave, and the capillary vessel member can be made in better contact to the air. Also, no compression force is locally given to the capillary vessel member. At this time, when the concave is made wide, the contact area between the capillary vessel member and the air is increased, and then the air can be uniformly entered into the capillary vessel member.

In accordance with the invention recited in aspect 3, the ink is dipped/held in the capillary vessel member stored in the ink chamber, and the ink is conducted from the atmospheric communication port into, for example, the print head. The concave is provided at the peripheral surface containing the atmospheric communication port within the ink chamber, and the atmospheric communication port is isolated from the capillary vessel member at this portion. As a result, the air entered from the atmospheric communication port into the ink chamber is spread over the entire concave. The air is entered from the portion of the concave into the capillary vessel member in connection with consumption of the ink. At this time, when the concave is made wider, the contact area between the capillary vessel member and the air is increased, and then the air can be uniformly entered into the capillary vessel member. Since the surface of the ink chamber is made in contact with the surface of the capillary vessel member at the portion other than the concave, the surface is not depressed at one point as the tab. Accordingly, no capillary vessel force is not increased at this portion. Therefore, the atmosphere can be properly supplied to the capillary vessel member of the ink chamber, and there is few ink left in the capillary vessel member, so that the ink dipped into the capillary vessel member employed in the ink chamber can be effectively utilized at maximum.

In particular, according to the present invention as recited in aspect 4, it is so arranged that the portion of the peripheral surface of the ink chamber containing the atmospheric communication port except for the concave portion does not compress the capillary vessel member. Thus, without increasing the capillary vessel force of this portion, the atmosphere can be properly supplied to the capillary vessel member. The amount of the ink left in this portion can be decreased, and the utilization efficiency of the ink can be improved.

According to the invention as recited in aspect 5, it is so arranged that the compression degree of the capillary vessel member near the atmospheric communication port is lower than, or equal to the compression degree of the capillary vessel member near a center portion thereof. Accordingly, the ink is not left near the atmospheric communication port of the capillary vessel member, but is moved to such a portion which compression degree is higher, so that the ink remaining amount is decreased and the ink utilization efficiency can be improved.

According to the present invention as recited in aspect 6, the concave is provided at a portion of a surface located opposite to such a surface where the communication port of the ink chamber is formed. Since the air is entered from the portion opposite to the concave into the capillary vessel member, the ink is used from the portion far from the communication port and the air is entered, so that the ink can be effectively consumed.

According to the invention as recited in aspect 7, since the air communication port is provided in the upper surface of the ink chamber, the air is entered into the capillary vessel member in connection with lowering of the ink surface when the ink is consumed. Thus, the ink can be effectively used. The concave formed around the air communication port is formed as the groove exerting along the longitudinal direction of the ink chamber. As a result, the air band is fabricated on the upper portion of the capillary vessel member, and the air can be spread above the capillary vessel member in conjunction with consumption of the ink, so that remaining of the ink can be reduced.

In accordance with the invention as recited in aspect 8, an area of the concave is equal to an approximately half of an area of the surface where the atmospheric communication port of the ink chamber. As a result, the area where the capillary vessel member is made in contact with the air layer is made large, and no concentrated depression force caused by the surface where the atmospheric communication port is formed is applied. Thus, remaining of the ink can be reduced.

In accordance with the invention as recited in aspect 9, the ink chamber is made being mounted with the lid. The atmospheric communication port and the groove are fabricated in this lid. This lid may function similar to the above-described concave, and thus the air can be entered from the air layer formed in the groove into the capillary vessel member. As a consequence, the air can be uniformly entered, and the amount of ink left in the capillary vessel member within the ink chamber is reduced, so that the ink dipped into the capillary vessel member within the ink chamber can be utilized in maximum efficiency.

In particular, according to the invention as recited in aspect 10, since it is so arranged that the capillary vessel member is not compressed by the portion other than the groove of the lid. Thus, the amount of ink remaining in the portion of the capillary vessel member made in contact with the portion other than the groove of the lid, so that the ink use efficiency can be improved.

In accordance with the invention as recited in aspect 11, in the structure having the lid, the compression degree of the capillary vessel member near the atmospheric communication port is lower than, or equal to the compression degree of the capillary vessel member near a center portion thereof. Similar to aspect 3, since the ink is not reservoired near the atmospheric communication port of the capillary vessel member, but is transported to the portion whose compression degree is high, the ink remaining amount can be reduced and the ink using efficiency can be improved.

According to the invention as recited in aspect 12, the concave is provided on the side of the capillary vessel member. This concave may function similar to the above-described concave. The air can be entered from the air layer formed in the concave into the capillary vessel member. As a result, since the air can be uniformly entered and the amount of ink left in the capillary vessel member within the ink chamber is reduced, so that the ink dipped into the capillary vessel member within the ink chamber can be utilized in maximum efficiency. Also, according to the present invention as recited in aspect 13, the lid is provided with the ink tank, and the atmospheric communication holes formed in this lid are communicated with the concave of the capillary vessel member, so that the air can be supplied to the capillary vessel member.

In particular, according to the present invention as recited in aspect 14, it is so arranged that the portion of the peripheral surface of the ink chamber containing the atmospheric communication port except for the concave portion does not compress the capillary vessel member. Thus, without increasing the capillary vessel force of this portion, the atmosphere can be properly supplied to the capillary vessel member. The amount of the ink left in this portion can be decreased, and the utilization efficiency of the ink can be improved.

According to the invention as recited in aspect 15, it is so arranged that the compression degree of the capillary vessel member near the atmospheric communication port is lower than, or equal to the compression degree of the capillary vessel member near a center portion thereof. Accordingly, the ink is not left near the atmospheric communication port of the capillary vessel member, but is moved to such a portion which compression degree is higher, so that the ink remaining amount is decreased and the ink utilization efficiency can be improved.

Also, in accordance with the invention as recited in aspect 16, in the ink tank as in any one of the preceding aspects 1 to 15, the ink tank includes the meniscus forming member formed on the communication port, arranged in contact with the capillary vessel member, and in which a plurality of very small holes are formed. Based upon the pressure produced when the air breaks the meniscus of the ink formed in the very small holes of the meniscus forming member to be entered, namely the bubble point pressure of the meniscus forming member, the upper limit value of the ink pressure within the ink tank is defined. The ink dipped into the capillary vessel member inside the ink chamber can be finally and effectively used by setting the bubble point pressure of the meniscus forming member. The bubbles reached the communication prot is trapped by the meniscus forming member so as to avoid entering of the bubbles into the print head.

Also, in accordance with the invention as recited in aspect 17, the ink tank further comprises the intermediate ink chamber corresponding to the small chamber under highly sealing condition; and the communication path communicated to the communication port of the ink chamber, the intermediate ink chamber, and the print head. The bubble existing within the communication path and the air conducted from the meniscus forming member are accumulated by this intermediate ink chamber in order to avoid entering of the bubbles into the print head. Even under such a condition that the bubbles are accumulated in the intermediate ink chamber, since the intermediate ink chamber is highly sealed, the negative pressure at the flow path of the ink can be maintained under better condition. Furthermore, the ink present within the intermediate ink chamber and the communication path can be depleted by the bubble point pressure of the meniscus forming member, so that the ink using efficiency can be increased.

Then, in accordance with the invention as recited in aspect 18, since the capillary vessel member is the porous material, the ink can be held by way of the capillary force and the proper negative pressure can be applied to the recording head.

Also, in accordance with the invention as recited in aspect 19, since the capillary vessel member is the three-dimensionally branched filaments, the ink can be held by way of the capillary force and the proper negative pressure can be applied to the recording head.

Also, in accordance with the invention as recited in aspect 20, since the capillary vessel member is the material spun in the three-dimensional form, the ink can be held by way of the capillary force and the proper negative pressure can be applied to the recording head.

Also, in accordance with the invention as recited in aspect 21, since the capillary vessel member is the bundled fiber material, the ink can be held by way of the capillary force and the proper negative pressure can be applied to the recording head.

According to the present invention as recited in aspect 22, the recording apparatus can be constituted by employing the ink tank as in any one of the preceding aspects 1 to 21. In this recording apparatus, since the ink using efficiency is high, the overall recording apparatus can be made in compact and at low cost, and further the running cost thereof can be reduced because of the compact ink tank.

Further, the present invention has been contrived in view of the foregoing problems, and the object of this invention is to provide an ink tank which prevents the leakage of ink from an atmospheric communication hole and enables effective utilization of the inside of the tank and a reduction in the size of the same, and further to an ink-jet recorder using the ink tank.

In accordance with aspect 23 of the present invention, there is provided an ink tank having an atmospheric communication hole, comprising a guard member bonded to an interior surface of the ink tank having the atmospheric communication hole; and one or more air chambers formed by the guard member, wherein air is introduced into the ink tank from the atmospheric communication hole via the air chambers.

Preferably, the atmospheric communication hole is formed in a cover, and the guard member is bonded to the reverse side of the cover.

Preferably, partitions are integrally formed around the atmospheric communication hole or on the guard member, and the air chambers are formed by means of the partitions.

Preferably, channels are formed in the partitions or the areas corresponding to the partitions.

In accordance with aspect 24 of the present invention, there is provided an ink-jet printer comprising the foregoing ink tank.

BRIEF DESCRIPTION OF THE DRAWINGS

FIG. 19 is a perspective view for indicating a condition of the carriage portion after the ink tank is mounted in the ink tank according to the first embodiment of the present invention;

DETAILED DESCRIPTION OF THE PREFERRED EMBODIMENTS

Figure 1:
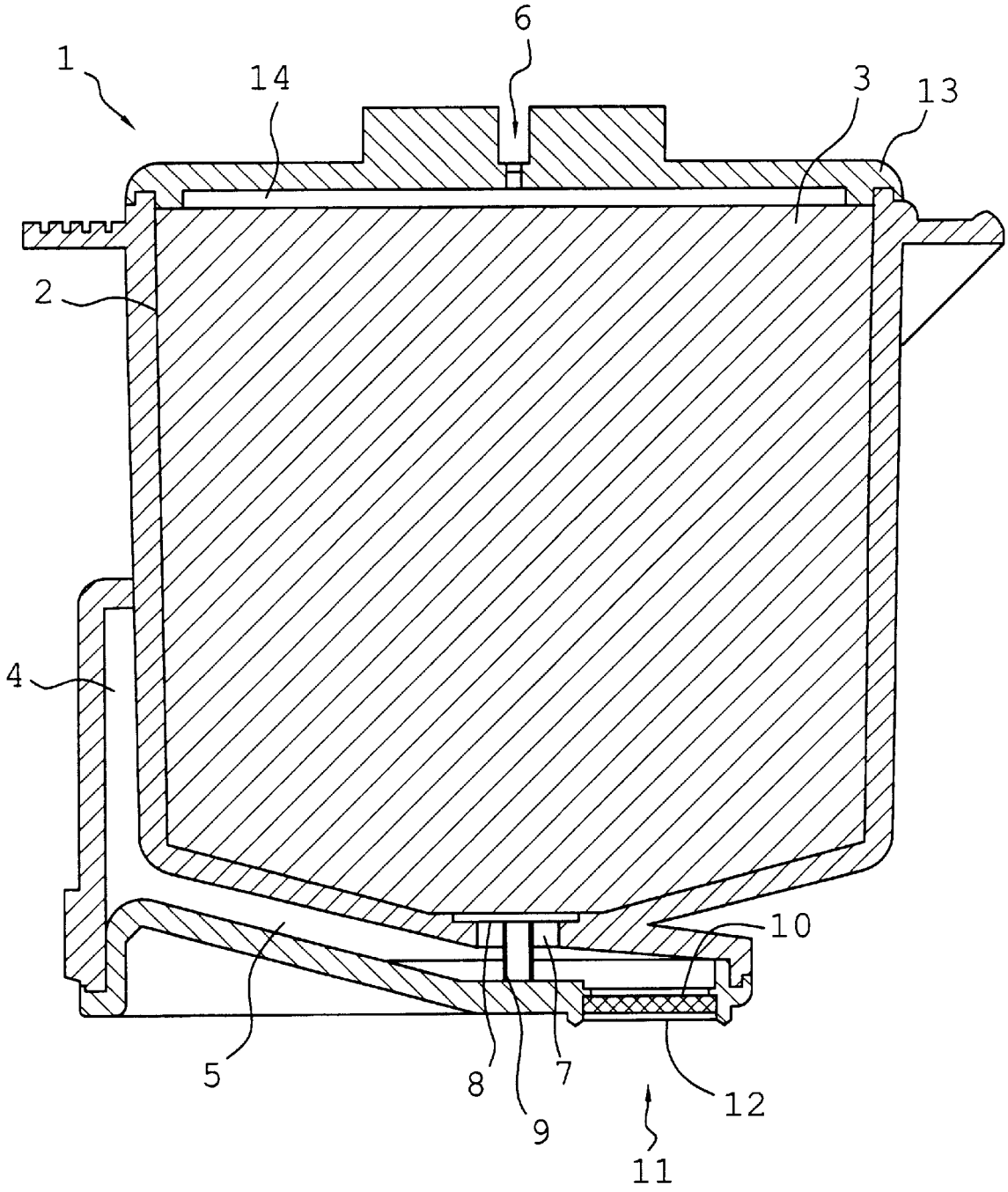
FIG. 1 is a sectional view for representing an ink tank according to a first embodiment of the present invention.
Figure 2:
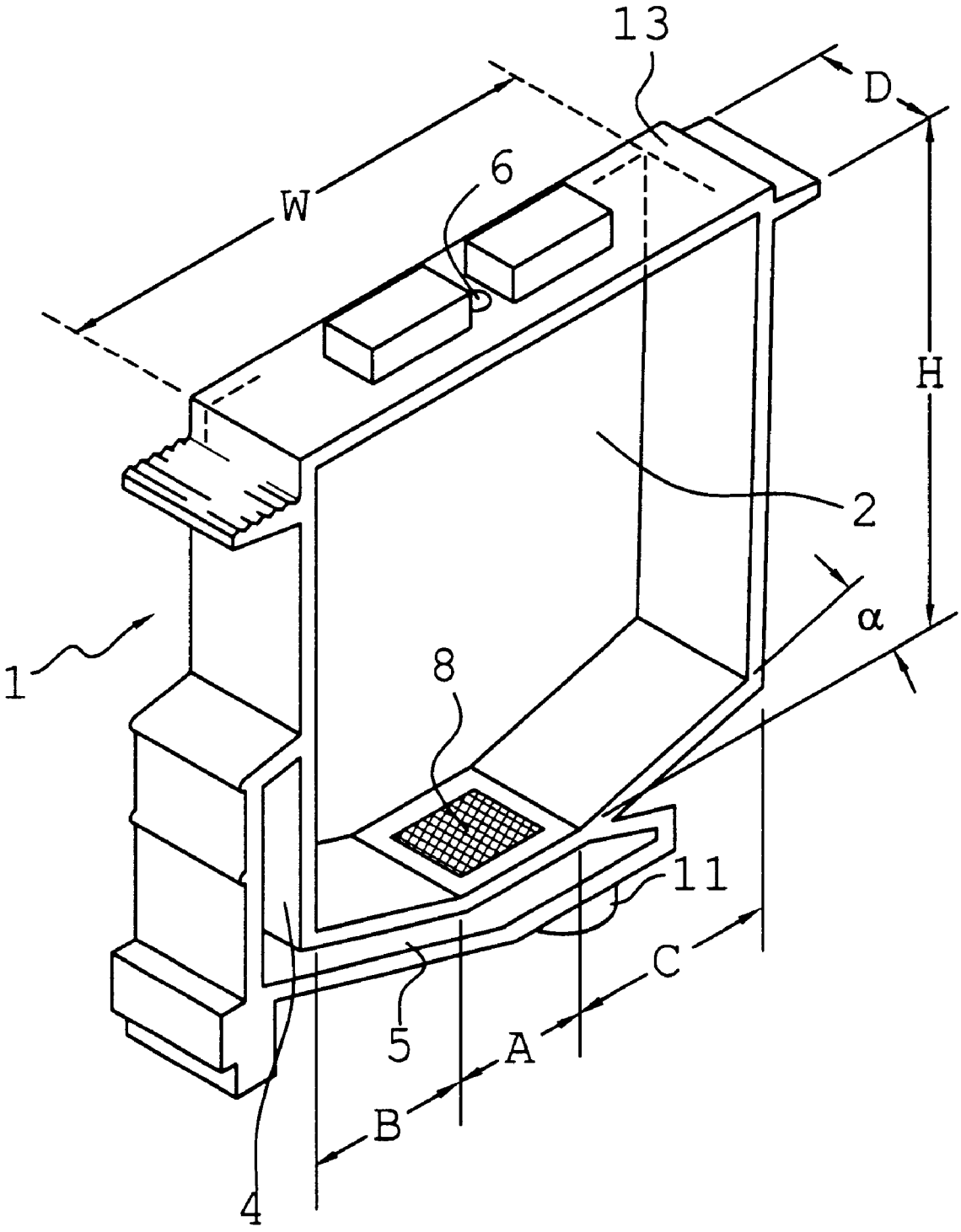
FIG. 2 is a sectional/perspective view for representing an ink tank according to a first embodiment of the present invention.
Figure 3:
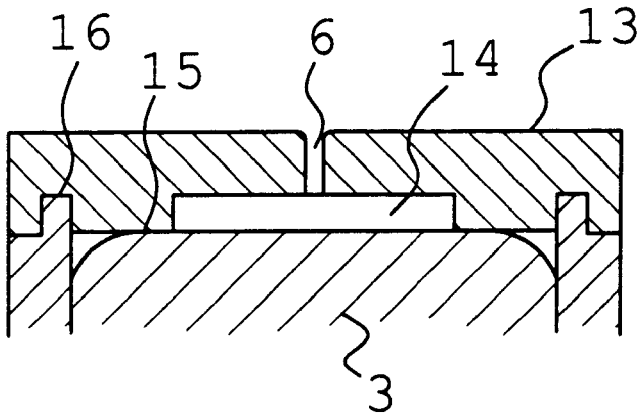
FIG. 3 is an enlarged view for showing another sectional view of the upper unit of the main ink chamber of the ink tank according to the first embodiment of the present embodiment.
Figure 4:
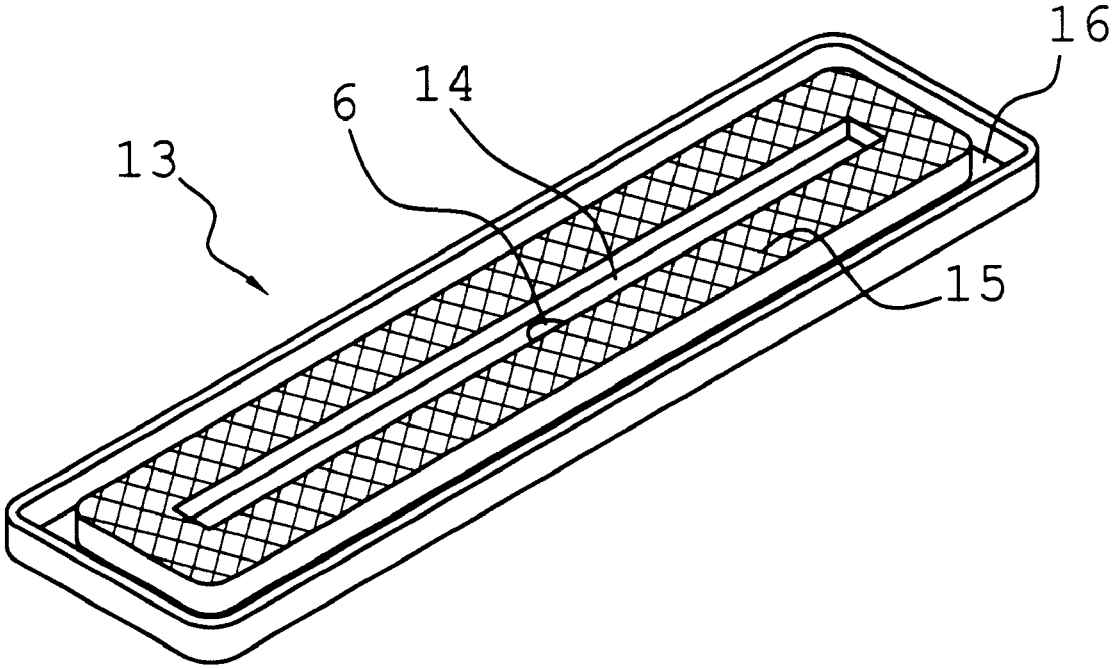
FIG. 4 is a perspective view for indicating one example of the shape of the lid employed in the ink tank according to the first embodiment of the present invention.
Figure 5:
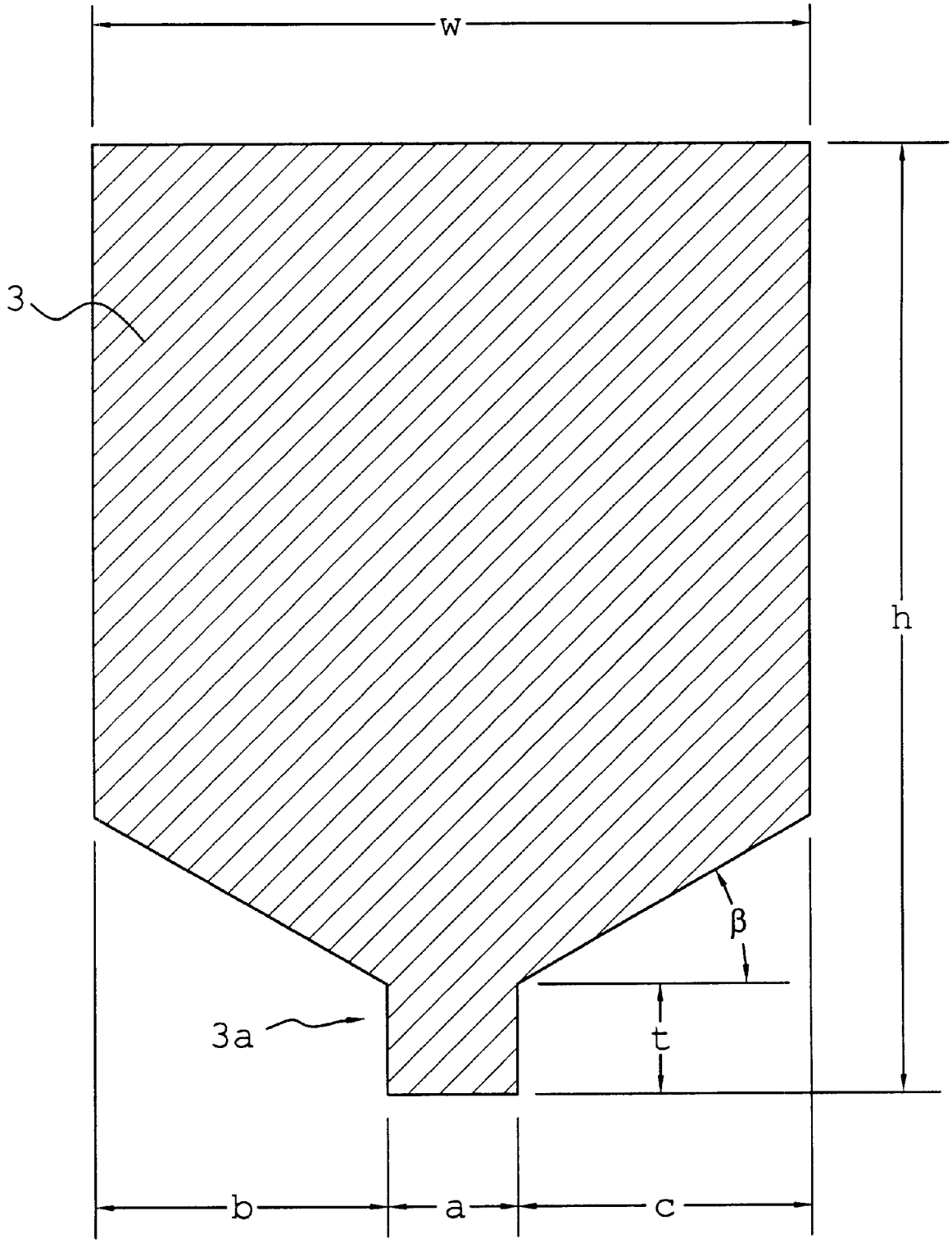
FIG. 5 is a sectional view for representing one example of the shape of the capillary vessel member employed in the ink tank according to the first embodiment of the present invention.

FIG. 1 to FIG. 5 are to explain an ink tank according to a first embodiment of the present invention. FIG. 1 is a sectional view of the ink tank. FIG. 2 is a perspective view of the ink tank. FIG. 3 is an enlarged diagram for representing another sectional view of an upper portion of a main ink chamber in the ink tank. FIG. 4 is a perspective view for showing one example of a lid shape. FIG. 5 is a sectional view for showing one shape example of a capillary vessel member. In the drawing, reference number 1 indicates an ink tank, reference number 2 denotes a main ink tank chamber, reference numeral 3 represents a capillary vessel member, reference numeral 4 indicates an intermediate ink chamber, and reference numeral 5 shows a communication path. Reference numeral 6 is an atmospheric communication port, reference numeral 7 shows a communication hole, reference numeral 8 indicates a first meniscus forming member, reference numeral 9 shows an ink supply unit, reference numeral 10 represents a second meniscus forming member, reference numeral 11 is a joint port, reference numeral 12 shows an absorbing member, reference numeral 13 represents a lid, reference numeral 14 denotes a groove, and reference numeral 16 represents a concave. In this embodiment, there are shown a print head and a separate type ink tank. FIG. 2 represents the print head and the ink tank except for a front side wall and the capillary vessel member 3. FIG. 3 is such a sectional view along the direction perpendicular to the sectional view of FIG. 1.

Within the ink tank 1, the main ink chamber 2 and the intermediate ink chamber 4 beside this main ink chamber 2 are provided. The housing of the ink tank 1 has stiffness, and such a material having a better ink resistance characteristic in order that the ink can be held for a long time. The upper portion of the main ink chamber of the ink tank 1 is constituted as the lid 13 in a separate form, and is fixed to the main body by way of such a fixing means as ultrasonic melting means. The joint port 11 is provided at the lower portion of the ink tank 1. This joint port 11 is connected to a print head (not shown). The ink within the main ink chamber 2 passes through the communication path 5, and is supplied via this joint port 11 to the print head.

In the lid 13 at the upper portion of the main ink chamber 2, the atmospheric communication portion 6 capable of being atmospheric-communicated with the capillary vessel member 3. In this embodiment, a diameter of the atmospheric communication port 6 is made larger than either the hole of the capillary vessel member 3 or the space between the fibers. The capillary vessel member 3 is communicated at its upper portion with the atmosphere, and is released under atmospheric pressure. When the ink is supplied to the ink head, the ink within the capillary vessel member 3 is depressed by the atmospheric pressure. Also, the ink is drawn from the lower portion of the capillary vessel member 3 to the communication path 5 by the negative pressure, the ink of the capillary vessel member 3 can be effectively used. At this time, the negative pressure in the print head can be kept constant due to the capillary force of the capillary vessel member 3. It is also possible to employ a sheet for causing air to pass therethrough, but the ink not to pass at the atmospheric communication port 6 in order that the ink does not jump from the atmospheric communication port 6. Alternatively, the atmospheric communication port 6 may be constructed by making a large number of very small holes through which no ink can pass.

As indicated in FIG. 4, the surface of the lid 13 located opposite to the capillary vessel member 3 is constructed of a plane portion 15 and a groove 14 extending along the longitudinal direction is formed at a center portion of this plane portion 15. Then the atmospheric communication port 6 is formed in this groove 14. Therefore, as shown in FIG. 3, the capillary vessel member 3 is isolated from the atmospheric communication port 6 by this groove 14. In connection therewith, the air layer is formed at the upper surface of the capillary vessel member 3, and it is so arranged that the air may be spread over the wide range of the upper surface of the capillary vessel member 3. In this portion, since the capillary vessel member 3 is under release condition, the compression degree around this capillary vessel member 3 can be set to be lower than, or equal to the compression degree near the center thereof. The lid 13 is merely made in contact with the capillary vessel member 3 and the plane portion 15, but is not compressed.

As concrete dimensions of the lid 13, for instance, when a depth "D" of the main ink chamber 2 is 13 mm and a width "W" thereof is 48.8 mm, the groove 14 having a width of 6 mm, a length of 46 mm, and a depth of 1.5 mm may be fabricated. At this time, a thickness of the lid 13 in the plane portion 15 is selected to be on the order of 3.5 mm. The atmospheric communication port 6 may be fabricated at the center portion of the groove 14. An inner diameter of the atmospheric communication port 6 may be selected to be 0.7 mm, for example.

Referring back to FIG. 1 and FIG. 2, the capillary vessel member 3 is arranged within the main ink chamber 2. This capillary vessel member 3 holds the ink by way of the capillary force and maintains the negative pressure in the recording head. As the material of the capillary vessel member 3, a fibrous material having a two-dimensional structure, a porous material having a three-dimensional structure, a felt made by spinning a fibrous material in a three-dimensional form and an unwoven material, and a three-dimensionally branched filaments may be used. Concretely speaking, for instance, a fiber bundle made by bundling a polyester fiber may be utilized. As this fiber bundle, for instance, density (=weight/volume) thereof is selected between 5% and 15%. Also, such a polyester felt may be used which is made by spinning a polyester fiber in a three-dimensional form. The density of this polyester felt is properly selected between 0.05 g/cm$^3$ and 0.1 g/cm$^3$. These selected density values are suitable in view of the capillary force and the fluid resistance with respect to the ink. It should be noted that the structure of the material is not limited to the polyester fiber, but other materials which own proper capillary force and ink resistance characteristics such as polypropylene may be used. In this embodiment, a polyester felt whose density is 0.05 g/cm$^3$ (when this polyester felt is mounted within the main ink chamber) is employed.

Also, as the three-dimensional mesh structure, fully open cell polyester polyurethan may be employed. As a preferable concrete example of this full open cell polyester polyurethan, "URTRA FINE (tradename)" may be used as described in Japanese Laid-open Patent Application No. 7-329313.

In FIG. 5, there is shown a shape of this capillary vessel member 3. Reference numeral 3*a* indicates a convexshaped portion. A bottom surface of this capillary vessel member is made of an inclined surface having an angle of "β°" with respect to such a surface positioned parallel to the upper surface of the capillary vessel member 3. Furthermore, the portion 3*a* positioned in contact with the communication hole formed by the meniscus forming member 8 shown in FIG. 1 and FIG. 2, is made in a convex shape having a height of t mm.

A relationship between an inclined angle "α" of the bottom portion of the main ink chamber 2 shown in FIG. 2 and the angle "β" shown in FIG. 5 becomes β>α, preferably β−α=15°. For instance, these angles may be selected as α=15° and β=30°. The height "t" of the concave-shaped portion 3*a* is preferably selected between 2 mm and 6 mm, for instance t=4 mm. When the capillary vessel member having such a shape is mounted in such a manner that as already explained in FIG. 1 and FIG. 2, this capillary vessel member is in contact with the entire bottom surface within the main ink chamber 2, the convex-shaped portion is compressed by the upper surface of the first meniscus forming member 8, so that in particular, the portion with high density is formed. Also around the communication hole 7, the portion near the communication hole 7 especially becomes high density due to a difference in the inclinations of the inclined surface, so that the density gradation is produced. As a consequence, when the ink is consumed in the recording head, the ink is transported from the edge of the capillary vessel member, where the density is low and the ink holding force is low. Thus, the amount of the finally remaining ink is very small, and the ink can be supplied at a high efficiency.

Furthermore, although the peripheral shape of the capillary vessel member 3 has the same shape of the inside of the main ink chamber 2, the size thereof is slightly larger than that of the main ink chamber 2. When this capillary vessel member 3 is mounted within the main ink chamber 2, the capillary vessel member 3 is more or less compressed by the side wall of the main ink chamber 2. As a consequence, such bubbles which are propagated from the side wall of the main ink chamber 2 to be entered can be suppressed, and thus the transfers of the bubbles to the communication hole 7 can be avoided. Also, the capillary vessel member 3 is made in contact with this side wall under pressure, so that the position of the capillary vessel member 3 is defined by this friction force. As a result, after the capillary vessel member 3 has been mounted into the main ink chamber 2, the position thereof can be maintained without being depressed by the lid 13. As a consequence, the plane portion 15 of the lid 13 is merely made in contact with the capillary vessel member 3, in a certain case. Even when the plane portion 15 is made in contact with the capillary vessel member 3, since the air is fed to the upper surface of the capillary vessel member 3 by the groove 14 under better conditions, the ink reservoired in the contact portion with the plane portion 15 can be reduced.

As to a concrete example of dimensions of the capillary vessel member for the ink tank indicated in FIG. 2, assuming now that a length of a horizontal portion of the first meniscus forming member 8 in the bottom surface of the ink tank is "A"; normal projection distances (horizontal distances) of inclined surface portions provided at both sides are "B" and "C"; a height from the horizontal portion to the lower surface of the lid 13 is "H"; a width in the lower surface of this lid 13 is "W"; and a depth thereof is "D", A=8.5 mm, B=19.4 mm, C=19.4 mm, H=50 mm, W=48.8 mm, and D=13 mm. With respect to a total value of A, B and C is 47.3 mm, since W is equal to 48.8 mm, the inner width dimension of the ink tank is slightly widened along the upper direction. This is because the ink tank can be easily pulled out from the mold when this ink tank is manufactured by way of a synthetic resin injection molding. It should be noted that the angle of the inclined surface portion α=10°. As one concrete dimensional example of the capillary vessel member inserted into this ink tank, assuming now that the width of the convex-shaped portion 3*a* shown in FIG. 5 is "a"; normal projection distances (horizontal distances) of the inclined surface portions provided a both sides thereof are "b" and "c"; an entire height from a tip portion of the convex-shaped portion 3*a* is "h"; a height of the convex-shaped portion 3*a* is "t"; a width of an upper portion is "w"; and a thickness thereof is "d", a=13 mm, b=18.5 mm, c=18.5 mm, h=62 mm, t=4 mm, and d=15 mm. Since an angle "β" of the inclined portion is equal to 25°, β−α=15°. Such a capillary vessel member 3 is inserted into the main ink chamber 2 under pressure, so that the upper surface of the capillary vessel member 3 becomes a height of 50 mm from the horizontal portion near the first meniscus forming member 8. As a result, the upper surface of the capillary vessel member 3 becomes such a height made in contact with the lower surface of the capillary vessel member 3.

Referring back to FIG. 1 and FIG. 2, another explanation will be made. The communication hole 7 is formed in the lower portion of the main ink chamber 2, and is communicated via the communication path 5 to the intermediate ink chamber 4 and the joint port 11. As the sectional shape of the communication hole 7, various shapes may be employed such as circular, ellipsoidal, polygon, star, cross, and slit shapes. The bottom surface of the main ink chamber 2 is formed as such an inclined surface that the communication hole 7 functions as the minimum low portion. This inclined surface is formed having the gradient angle of α° as shown in FIG. 2 with respect to the horizontal plane where the first meniscus forming member 8 is mounted.

The first meniscus forming member 8 is provided in the communication hole 7 formed in the bottom surface of the main ink chamber 2. The bottom portion of the capillary vessel member 3 is arranged on the first meniscus forming member 8 under pressure condition. As the first meniscus forming member 8, for example, a mesh-shaped member such a metal mesh and a resin mesh, and a porous body may be employed. For example, a resin fiber such as Twilled Dutch Weave, and a filter corresponding to a metal woven article, and also such a filter having a very fine hole diameter by the laser beam processing and the electron beam processing may be employed. As the shape of this mesh, it is possible to employ such a shape capable of covering the communication hole 7 as a circular and a rectangular.

When the ink is dipped into the capillary vessel member 3, the ink is penetrated through the first meniscus forming member 8 and transported to the intermediate ink chamber 4. Even when the ink is depleted in the capillary vessel member 3, the first meniscus forming member 8 prevents the unwanted air from being entered into the intermediate ink chamber 4. When the ink is further consumed, the air which has entered from the atmospheric communication port 6 passes through the capillary vessel member 3, and depresses the meniscus of the ink extended over the very small hole formed in the first meniscus forming member 8 in contact with the capillary vessel member 3. Then, this air can pass through this meniscus against surface tension to become bubbles. The produced bubbles pass through the communication path 5 and then is moved to the intermediate ink chamber 4. The pressure when the bubbles are produced (namely bubble point pressure) may depend upon filtering roughness of the first meniscus forming member 8. By properly selecting this filtering roughness, the negative pressure in the ink tank 1, namely the ink supply pressure to the print head can be kept constant. As the filtering roughness of the first meniscus forming member 8, for example, 40 to 70 micrometers may be utilized.

A portion of the first meniscus forming member 8 may be extended up to the bottom surface of the communication path 5 as the ink supply unit 9. This ink supply unit 9 has a smaller sectional dimension than the diameter of the communication hole 7. In the case that the bubbles are reservoired on the lower surface of the first meniscus forming member 8, so that a layer of air would be formed, or if the ink within the main ink chamber 2 is depleted, then the fluid surface of the ink would be lowered from the height of the communication path 7, this ink supply unit 9 sucks the ink from the bottom portion of the communication path 5, and then supplies the ink to the first meniscus forming member 8. As a consequence, the first meniscus forming member 8 can be continuously maintained under wet condition and the negative pressure can be kept. As a result, the best condition can be maintained until the ink is completely depleted. The shape of the ink supply unit 9 is arbitrarily selected from a slit shape, a cube, a triangular prism, a cylindrical shape, and an ellipsoidal prism.

Alternatively, the ink supply unit 9 may be constituted as a separate member which is directly mounted on the first meniscus forming unit 8 in order to be contact with the first meniscus forming member 8. Otherwise, it may be arranged to be fixed by a convex portion from the side wall of the communication hole 7. At this time, the material of the ink supply unit 9 may be not identical to that of the first meniscus forming member 8. Alternatively, any materials may be employed which can supply the ink to the first meniscus forming member 8 by the capillary force. For instance, there are employed a fiber bundle where polyester fabric or polypropylene fabric is bundled along one direction, a porous member such as polyurethane and melamine foam, and a two-dimensional-shaped fabric structural body, and also a three-dimensional-shaped fabric structural body. Fully open cell polyester polyurethan may be employed. As a concrete example, the above-described "URTRA FINE (tradename)" may be employed.

The communication path 5 is communicated with the intermediate ink chamber 4, the main ink chamber 2, and the joint port 11 in this order. Although the upper wall of the communication path 5 is made flat, as illustrated in FIG. 1, this upper wall may be made oblique in such a manner that this upper wall is gradually increased toward the intermediate ink chamber 4. As a result, the bubbles produced in the communication hole 7 may be smoothly moved to the intermediate ink chamber 4. This inclined surface may be made only in the section for connecting the intermediate ink chamber 4 with the main ink chamber 2. Alternatively, the upper surface of another section for connecting the main ink chamber 2 with the joint port 11 may be made oblique, so that the bubbles conducted from the joint port 11 can be smoothly to the intermediate ink chamber. Although the bottom surface of the communication path 5 may be made horizontal, only the section for communicating the intermediate ink chamber 4 with the main ink chamber 2 is formed as the inclined surface in this embodiment. The position of the joint port 11 is not limited to the illustrated position, but may be apparently located close to the intermediate ink chamber 4. Alternatively, the joint port 11 may be opened toward the side direction.

Under initial condition, the intermediate ink chamber 4 is filled with the ink. Then, the bubbles which have passed through the first meniscus forming member from the main ink chamber 2 and have entered into the communication path 5 are accumulated. The dimensions of the intermediate ink chamber 4 may be selected to be such dimensions capable of accumulating the bubbles suddenly entered into the intermediate ink chamber 4 until the ink filled in the main ink chamber 2 is depleted, and therefore may be constituted by a small chamber. To accumulate the bubbles, under such a condition that this ink tank 1 is mounted on a recording apparatus (not shown), the upper surface of the intermediate ink chamber 4 is located higher than the communication hole 7 of the main ink chamber 2.

The second meniscus forming member 10 and the absorbing member 12 are provided in the joint port 11 in this order.

Under such a state that the ink tank 1 is removed and released, there is no risk that the ink present within the intermediate ink chamber 4 and the communication path 5 are not overflown from the joint port 11 by surface tension of the ink produced in the very small hole formed in this second meniscus forming member 10. Also, the air which will remain at the joint port 11 by the pressure exerted when the ink tank 1 is mounted on the recording apparatus is penetrated through the ink film of the second meniscus forming member 10, and is transported to the intermediate ink chamber 4. As a result, the mixture of the bubbles into the print head can be reduced. Furthermore, under such a condition that the ink tank 1 is mounted, it is possible to avoid the vibrations and shock applied to the ink tank 1, the pressure variations caused by the acceleration speed, and the bubble mixtures of the print head from the nozzle side. As the material of the second meniscus forming member 10, such an SUS mesh whose meniscus open diameter becomes 10 to 50 micrometers may be employed, a narrow line of SUS is made in a felt form, or such a filter that the narrow lines are compressed and sintered to form a base member may be employed. The meniscus open diameter is determined based up the characteristics of the capillary vessel member 3 and also of the ink, and the sizes of the ink tank 1. This meniscus open diameter is so designed that the ink is not leaked under such a condition that the ink tank 1 is removed, and the air is not entered even when the ink tank 1 is reversed.

Also, the absorbing member 12 provided at the joint port 11 can prevent the ink attached to the joint port 11 from being dropped out when the ink tank 1 is mounted/released. A material having better ink absorbing force is utilized as the absorbing material 12. The absorbing member 12 may be constituted by a sponge, by bundling polyester fabric or polypropylene fabric, by a polyester felt. A low flow path resistance of this absorbing material 12 may be desired.

Figure 6:
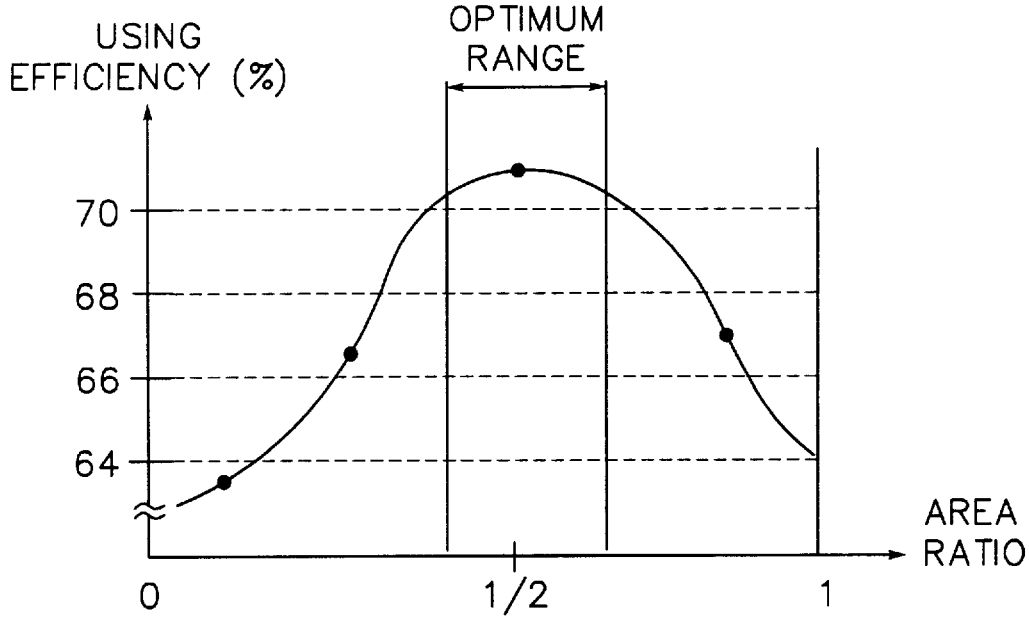
FIG. 6 is a graphic representation for showing a relationship between a ratio of a contact area of the lid to that of the capillary vessel member, and the using efficiency of the ink.

A further consideration will now be made of the above-explained lid 13. FIG. 6 is a graphic representation for showing such a representation between a ratio of the cross-section area of the capillary vessel member to the contact area between the lid and the capillary vessel member, and the use efficiency of the ink. FIG. 7 is an explanatory diagram about a relationship between the cross-section area of the capillary vessel member and the contact area between the lid and the capillary vessel member. Assuming now that the cross-section area of the capillary vessel member is constant, FIG. 6 may represent such a relationship between the contact area between the lid 13 and the capillary vessel member 3, namely a relationship between the area of the lid 13 for the plane portion 15, and the ink use efficiency. As indicated in FIG. 6, when the area of the plane portion 15 becomes approximately ½, the use efficiency of the ink becomes maximum. When this area of the plane portion 15 is further increased, or decreased, the use efficiency of the ink would be lowered.

Figure 7A:
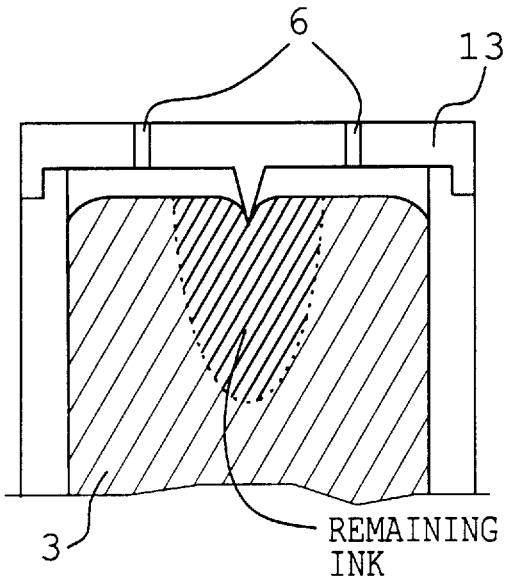
FIGS. 7A and 7B are explanatory diagrams for explaining the relationship between the sectional area of the capillary vessel member, and the contact areas of the lid and the capillary vessel member.
Figure 7B:
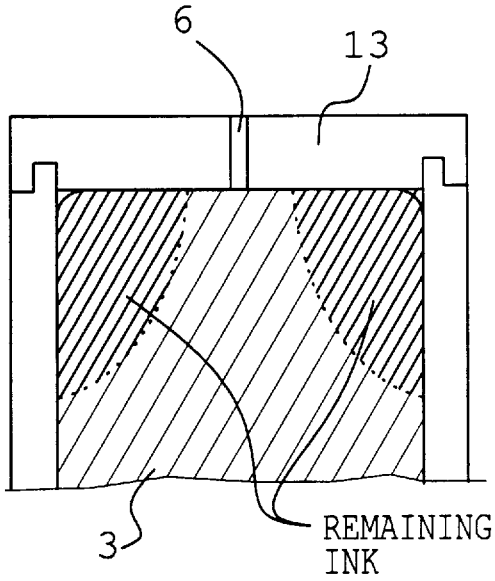

Considering now such a case that the area of the plane portion 15 is small, as indicated in FIG. 7A, it is approximated to such a point contact as employed in the conventional ink tank. As a result, it is conceivable that the ink would easily remain at the contact portion between the plane portion 15 and the capillary vessel member 3, and therefore the ink using efficiency would the lowered. Conversely, considering now another case that the area of the plane portion 15 is large, as shown in FIG. 7B, air could not readily enter into a space between the capillary vessel member 3 and the plane portion 15. Thus, it is conceivable that the ink would also remain at the contact portion, and thus the ink using efficiency would be lowered. As described above, in the case that the area of the plane portion 15 becomes excessively larger, or smaller than the cross section of the capillary vessel member 3, the ink using efficiency would be lowered. As a result, when the area of the plane portion 15 is made approximately a half of the cross section of the capillary vessel member 3, the ink can be effectively used.

Figure 8A:
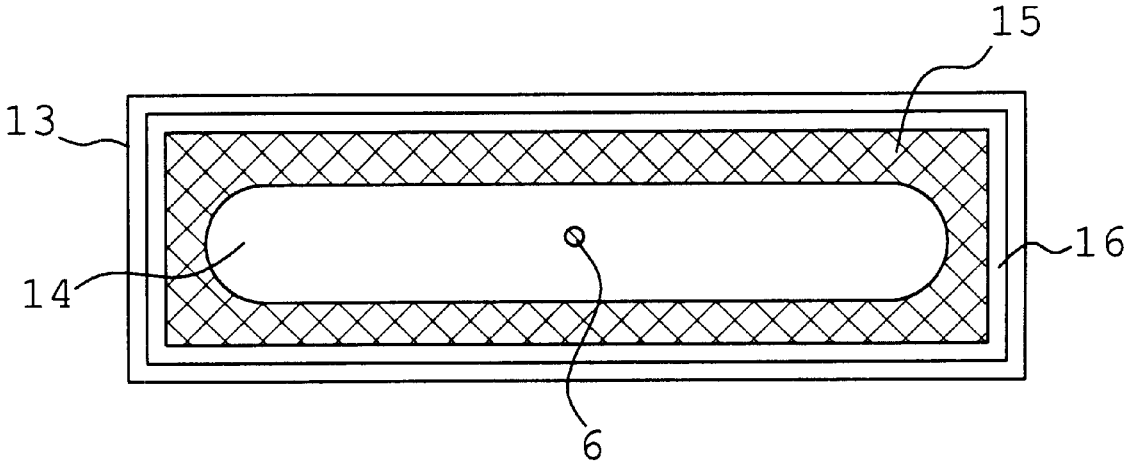
FIGS. 8A and 8B are plan views of showing another example of the lid 13.

FIG. 8 is a plan view for showing another example of the lid 13. As the shape of the groove 14 formed in the lid 13, there are various shapes other than a rectangular groove as indicated in FIG. 4. For example, as shown in FIG. 8A, the shape of the edge portion of the groove 14 may be made of either arc or elliptical. Alternatively, this shape may be made of, for example, such shapes having a cross-shaped portion, a partially widened portion, and a partially narrowed portion. At this time, when the groove is formed in such a manner that this groove is extended along the longitudinal direction, the ink remaining near the edge portion of the capillary vessel member 3 could be reduced, as compared with such a groove that a wide space is formed at a center portion thereof.

Figure 8B:
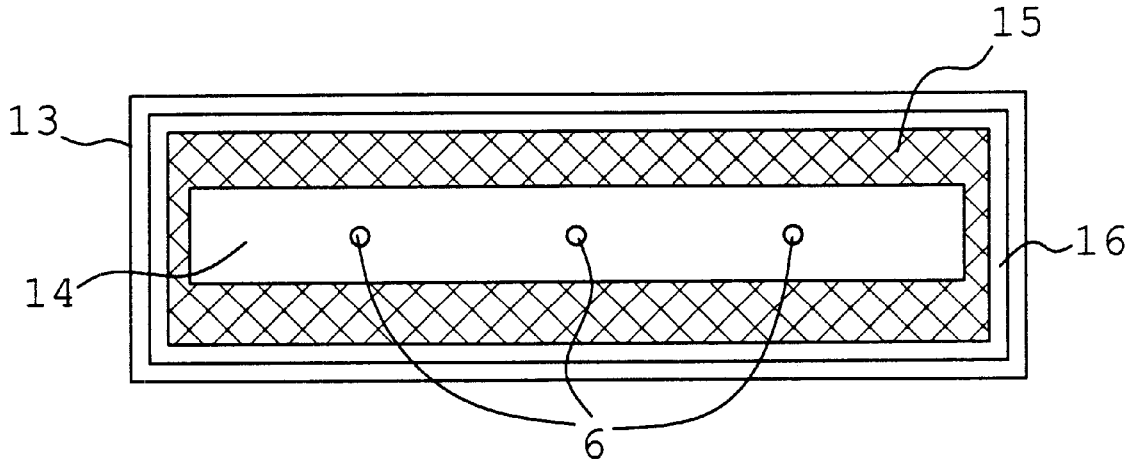

Also, the present invention is not limited to the number of atmospheric communication port 6 formed in the lid 13, i.e., 1. For example, as shown in FIG. 8B, a plurality of atmospheric communication ports 6 may be provided. When such plural atmospheric communication ports 6 are formed, the air can be sufficiently spread within the groove 14, and thus the air can be effectively penetrated into the capillary vessel member 3. When a plurality of atmospheric communication ports 6 are provided, the groove 14 may be subdivided into a plurality of subdivided groove portions. It should be understood that the atmospheric communication ports 6 may be positioned at not only the center portion of the groove 14, but also the edge portion of the groove 14.

Figure 9B:
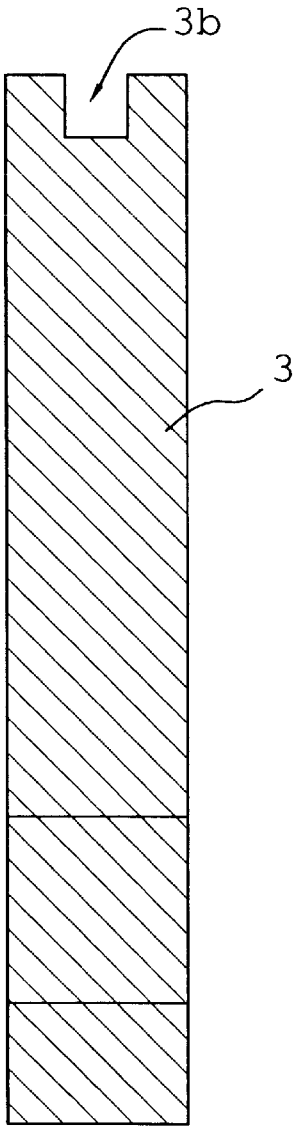
FIGS. 9A and 9B are perspective views for indicating one example of the shape of the capillary vessel member in the ink tank according to a second embodiment of the present invention.
Figure 9A:
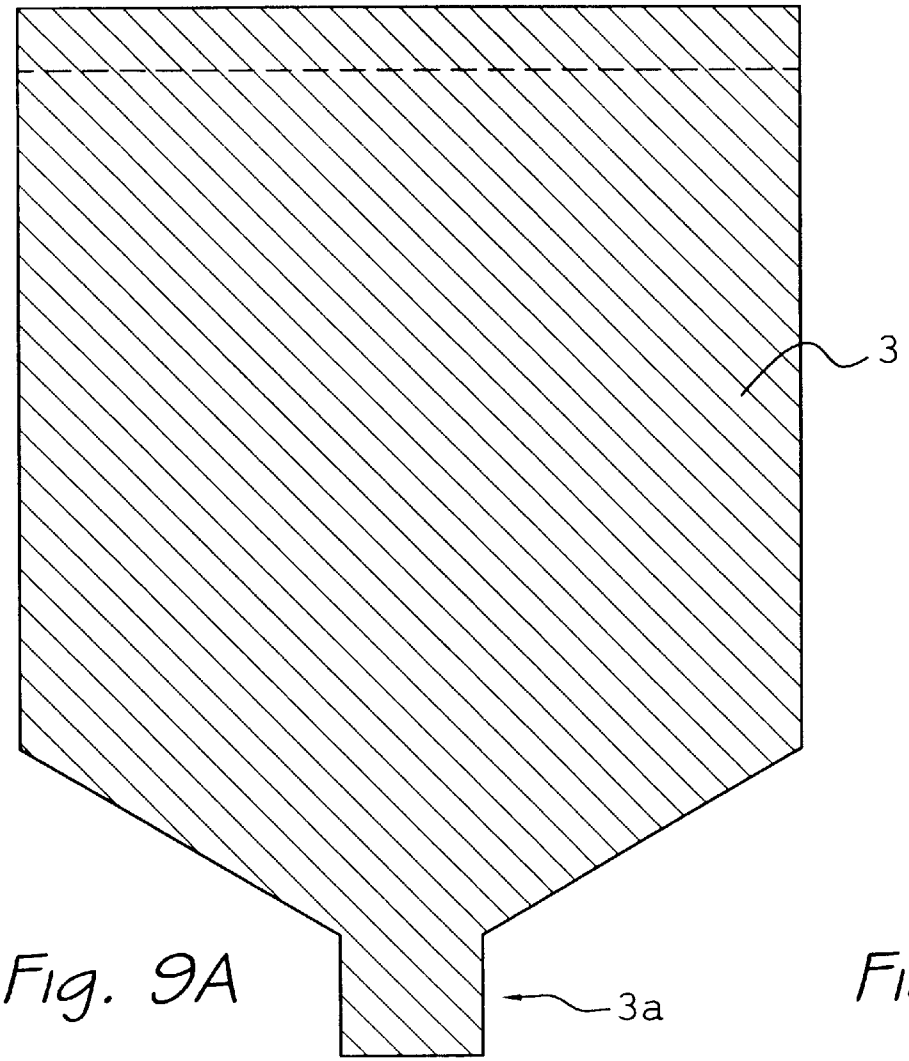
Figure 10:
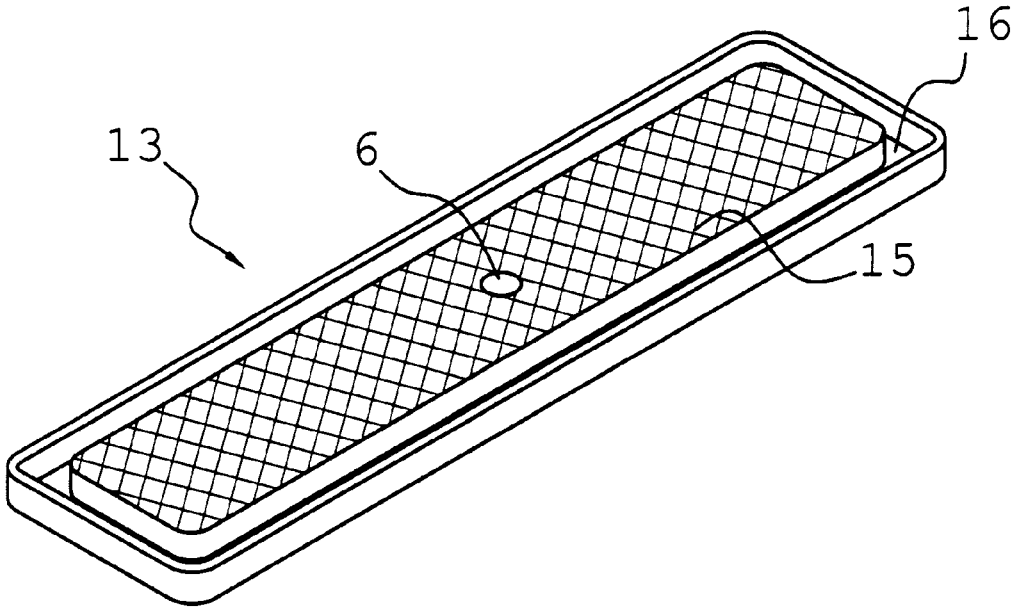
FIG. 10 is a perspective view for representing one example of the shape of the lid employed in the ink tank according to the second embodiment of the present invention.

FIG. 9 and FIG. 10 are explanatory diagrams for explaining an ink tank according to a second embodiment of the present invention. FIG. 9 is a sectional view for representing an example of a shape of a capillary vessel member, and FIG. 10 is a perspective view for indicating one example of a shape of a lid. As will be discussed later, according to the second embodiment, the portion of the lid is different from that of the first embodiment at the main body portion except for the capillary vessel member of the ink tank. However, since other portions are the same as those of FIG. 1 and FIG. 2, the explanations thereof are omitted.

A first description will now be made of the capillary vessel member. FIG. 9A is a sectional view of the same surface of this capillary vessel member as that of FIG. 5. FIG. 9B is a cross-sectional view of the central portion of this capillary vessel member shown in FIG. 9A. In the drawings, reference numeral 3 shows a capillary vessel member, and reference numeral 3*b* is a groove. Although the size and the shape of this capillary vessel member 3 may be made identical to those as explained in FIG. 5, the capillary vessel member 3 according to this second embodiment has such a different point that the groove 3*b* is fabricated in the upper surface thereof in contact with the lid. As will be explained later, the groove 3*b* is formed in such a manner that this groove 3*b* is directed to the transverse direction of FIG. 9A so as not to be in contact with the atmospheric communication hole formed in the lid of the ink. As a result, such a groove 14 as explained in FIG. 3 and FIG. 4 is no longer required in the lid of the ink tank. As one dimensional example of the groove 3*b*, a width of a section is 6 mm and a depth is 3 mm with respect to the dimensions explained in FIG. 5. It should be noted that although the sectional shape of this groove is a rectangular shape, this sectional shape is not limited thereto, but other shapes such as a triangle and a semicircle may be employed.

FIG. 10 is a perspective view for showing a lid suitably used in an ink tank where this capillary vessel member is employed. The same reference numerals shown in FIG. 4 will be employed as those for denoting the same or similar portions indicated in FIG. 10, and explanations thereof are omitted. Similar to FIG. 4, a hatched portion is employed so as to clearly illustrate a surface in contact with the capillary vessel member. As apparent from the drawing, no longer such a groove 14 as explained in FIG. 4, and therefore there is such a merit that the structure of the lid can be made simple. To the contrary, as previously explained in FIG. 4, there is no problem to employ a lid with the groove. The number of the atmospheric communication hole 6 is not limited to 1, but may more than 1.

Figure 11:
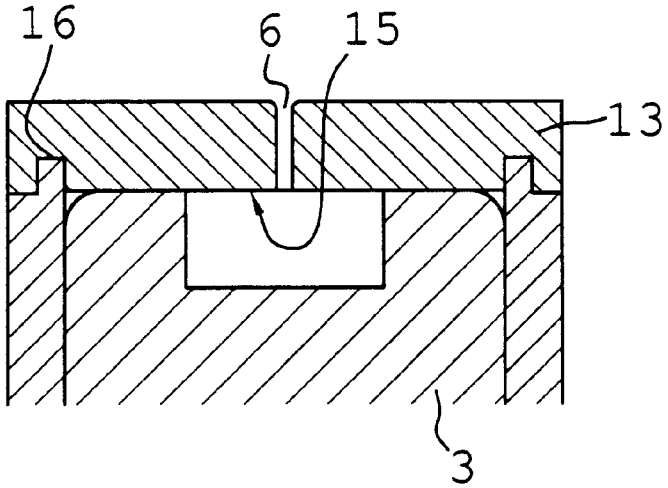
FIG. 11 is a sectional view for showing the ink tank with employment of the capillary vessel member according to the second embodiment of the present invention.

FIG. 11 is a sectional view for showing an ink tank where this capillary vessel member is employed. The same reference numerals shown in FIG. 3 will be employed as those for denoting the same or similar portions indicated in FIG. 11, and explanations thereof are omitted. Since the atmospheric communication port 6 formed in the lid 13 is located opposite to the groove 3*b* of the capillary vessel member 3, the capillary vessel member 3 is not directly in contact with the atmospheric communication port 6, but also the capillary vessel member 3 is not compressed by the surface having the atmospheric communication port 6. As a consequence, it is possible to properly supply the air to the capillary vessel member provided inside the main ink chamber without unnecessarily increasing the capillary force at the portions other than the ink supply port.

FIG. 12 to FIG. 16 are explanatory diagrams for explaining one example of operations of the ink tank according to the first embodiment of the present invention, which are similar to the ink tank according to the second embodiment. In the respective drawings, the print head portion connected to the joint port is omitted. FIG. 12A to FIG. 16A represent remaining amounts of the ink, whereas FIG. 12B to FIG. 16B show graphic representations for indicating static (hydrostatic) pressure of the ink and dynamic pressure of the ink. The static pressure of the ink implies such pressure when no printing operation is carried out. This static pressure is produced from the pressure caused by the capillary force of either the absorption member or the meniscus forming unit, and the head pressure from the fluid surface of the ink. Also, the dynamic pressure of the ink is conceivable as a summation a loss in pressure produced by a flow rate of the ink and a fluid resistance in a flow path system, and the static pressure of the ink. The ink dynamic pressure in the respective figures is measured during the set-solid printing operation.

Figure 12A:
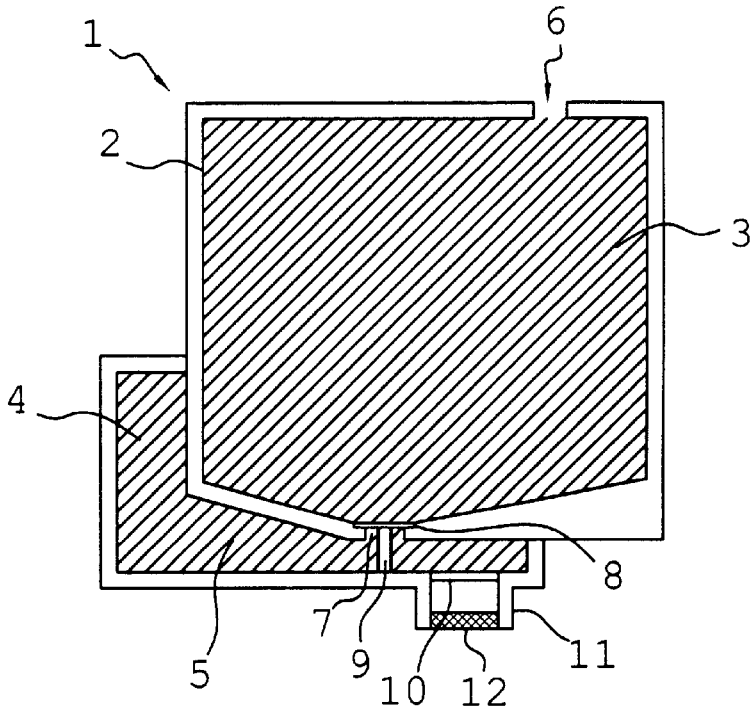
FIGS. 12A and 12B are explanatory diagrams for explaining an initial condition of the operations of the ink tank according to the first embodiment of the present invention.
Figure 12B:
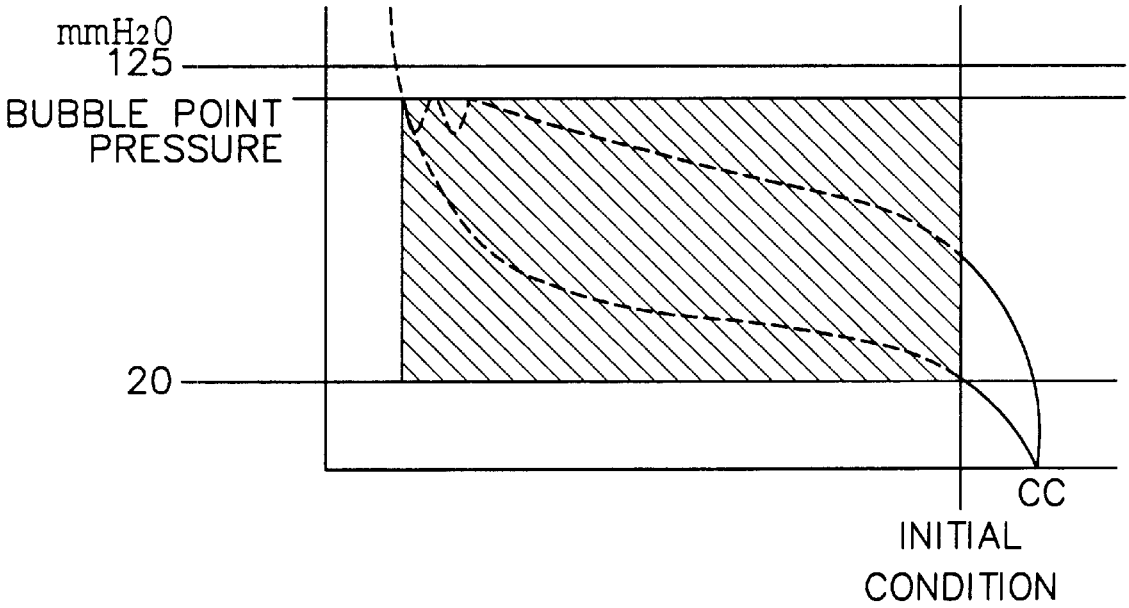

FIG. 12A represents an initial condition when the ink tank shown in FIG. 1 is filled with the ink. Under this initial condition, the ink is filled into the main ink chamber 2 up to such a limit held by the capillary force exerted by the capillary vessel member 3. In view of the ink using efficiency, the main ink chamber 2 is filled with the ink as much as possible as the starting condition. However, in order to produce the negative pressure by the capillary vessel force of the capillary vessel member 3, the ink unfilled portion is required in the capillary vessel member 3 to some extent. Also, the intermediate ink chamber 4 is filled with the ink. In the following description, the initial condition of the ink pressure in the print head is set to, for instance, −20 mm $H_2O$. Under such an initial condition before the ink tank is mounted, this ink pressure can be realized by way of the capillary force of the capillary vessel member 3 so as to hold the ink. The pressure of the ink existing in the intermediate ink chamber 4 and the communication path 5 becomes also negative pressure, and this negative pressure can be maintained by the boundary of the ink formed in the very small holes of the second meniscus forming member 10. Before using the ink tank, both the joint port 11 and the atmospheric communication port 6 may be attached with air tight seals. Under this condition, the ink tank 1 is packaged. When the ink tank 1 is used, these air tight seals are removed and thereafter the ink tank 1 have no air tight seals is mounted on the recording apparatus. The static pressure and the dynamic pressure of the ink just after this ink tank is mounted are indicated in FIG. 12B.

When the ink tank 1 is mounted, there are some possibilities that more or less air will be left in the joint port 11. The remaining air will depress the boundary of the ink formed in the second meniscus forming member 10 by the pressure caused when the ink tank is mounted, and then is penetrated into the communication path 5 as bubbles. The bubbles penetrated into the communication path 5 are moved along the gradient of the upper surface of the communication path 5 by buoyancy of the bubbles themselves, and then are accumulated or integrated into the intermediate ink chamber 4.

Figure 13A:
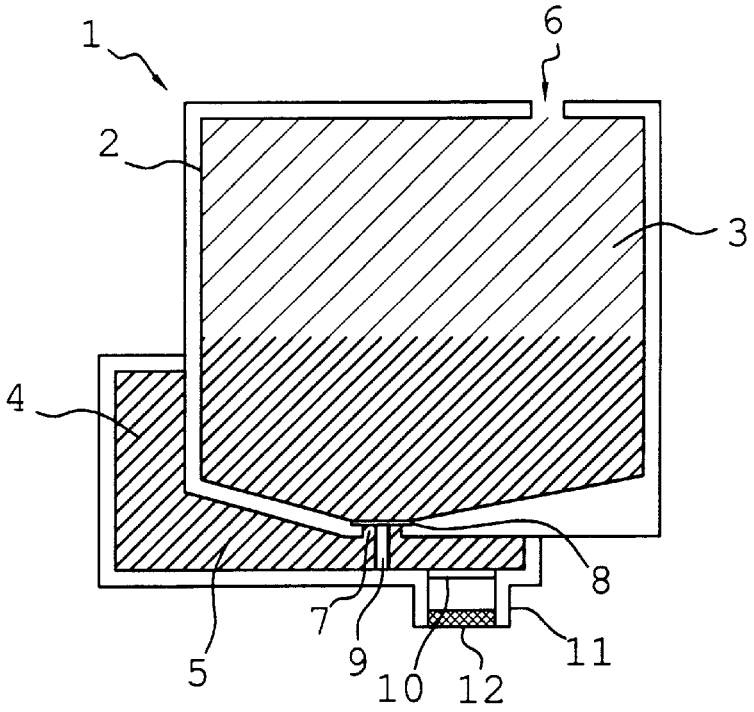
FIGS. 13A and 13B are explanatory diagrams for explaining an intermediate condition of the operations of the ink tank according to the first embodiment of the present invention.

After the ink tank 1 has been mounted, when the printing operation is commenced, the ink is consumed in the print head. Then, as indicated in FIG. 13A, the air is gradually penetrated into the groove 14 from the atmospheric communication port 6 only by the amount of the consumed ink, and further is penetrated into the capillary vessel member 3 to be thereby spread. At this time, since the lid 13 does not depress the capillary vessel member 3, the ink held in the capillary vessel member 3 is moved along the first meniscus forming member 8 under better condition, so that such ink remaining at the contact portion between the lid 13 and the capillary vessel member 3 is reduced.

Figure 13B:
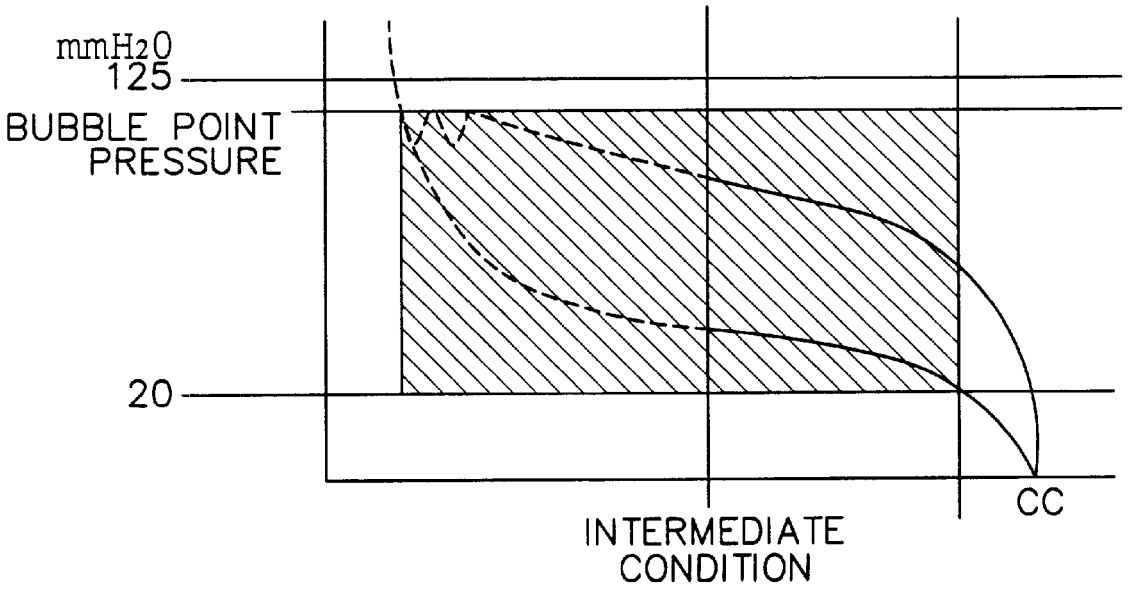

While the amount of ink held in the capillary vessel member 3 is reduced, the head pressure of this ink is lowered, and as indicated in FIG. 13B, the negative pressure is gradually increased but is shifted within the allowable range. Even when the amount of ink becomes small, the ink can be supplied under the stable negative pressure by way of the capillary force owned by the capillary vessel member 3. The ink held by the capillary vessel member 3 is smoothly moved through the first meniscus forming member 8 to the communication path 5.

While the ink is supplied during the normal printing operation, the air entered from the atmospheric communication port 6 is penetrated through the wall surface of the main ink chamber 2 into the first meniscus forming member 8. Only very small amount of air could reach the side surface and the bottom surface of the main ink chamber 2 due to pressure contact with the capillary vessel member 3 in the side surface and the bottom surface of the main ink chamber 2. Even if a very small amount of air has reached the surface of the first meniscus forming member 8, while the air remains trapped on the first meniscus forming member 8, the ink is continued to be moved. In another case that the bubbles mixed in the ink pass through the capillary vessel member 3, and then the air is in contact with the upper surface of the first meniscus forming member 8, the air can be trapped on the first meniscus forming member 8 by setting the filtering grain size of the first meniscus forming member 8 to be made smaller than that of the capillary vessel member 3, so that the ink is continued to be moved. The ink is transported from the main ink chamber 2 to the intermediate ink chamber 4 until the ink held in the capillary vessel member 3 is substantially completely depleted.

Under such a condition that the bubbles are trapped on the surface of the first meniscus forming member 8, the ink is absorbed from the nozzle tip portion as the maintenance operation in order to avoid the nozzle plugging by the ink. In this case, since the ink is forcibly absorbed from the nozzle tip portion, higher negative pressure than the negative pressure under normal condition will be produced. Also, when a large amount of ink is consumed during the set-solid printing operation, such higher negative pressure than the negative pressure under normal condition will be produced. There are few cases that the bubbles trapped on the surface of the first meniscus forming member 8 are captured from the very fine holes into the communication path 5 together with the ink. The bubbles captured into the communication path 5 of the first meniscus forming member 8 are propagated onto the inclined upper surface of the communication path 5 into the intermediate ink chamber 4 due to the buoyancy of the bubbles themselves. Then, these bubbles are accumulated in the upper portion of the intermediate ink chamber 4. Even when the surface on the side of the communication path 5 of the first meniscus forming member 8 is covered with the bubbles, the negative pressure is maintained by the surface tension owned by the boundary surface of the ink formed in the very fine holes of the first meniscus forming member 8.

Figure 14A:
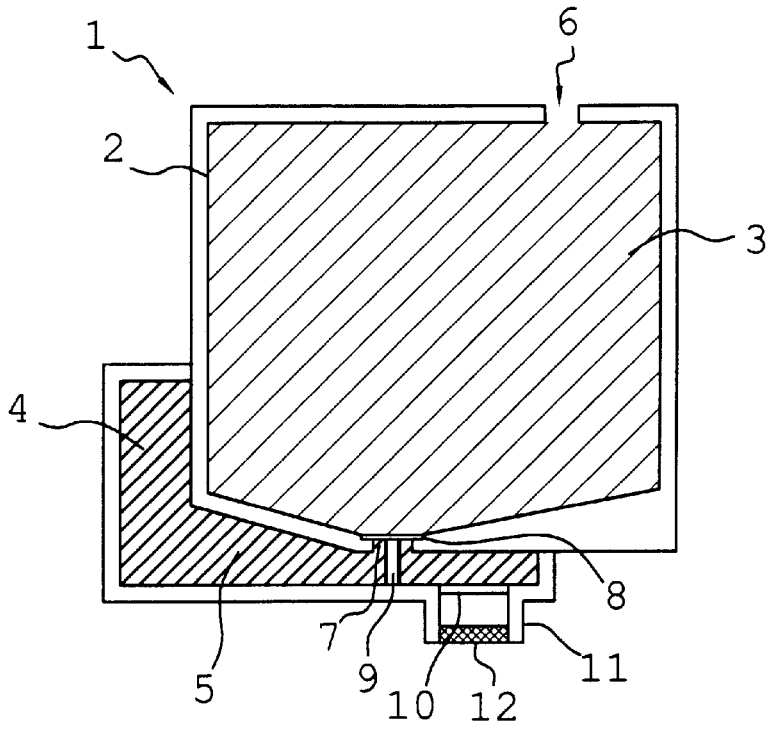
FIGS. 14A and 14B are explanatory diagrams for explaining an ink ending condition in the main ink chamber of the operations of the ink tank according to the first embodiment of the present invention.
Figure 14B:
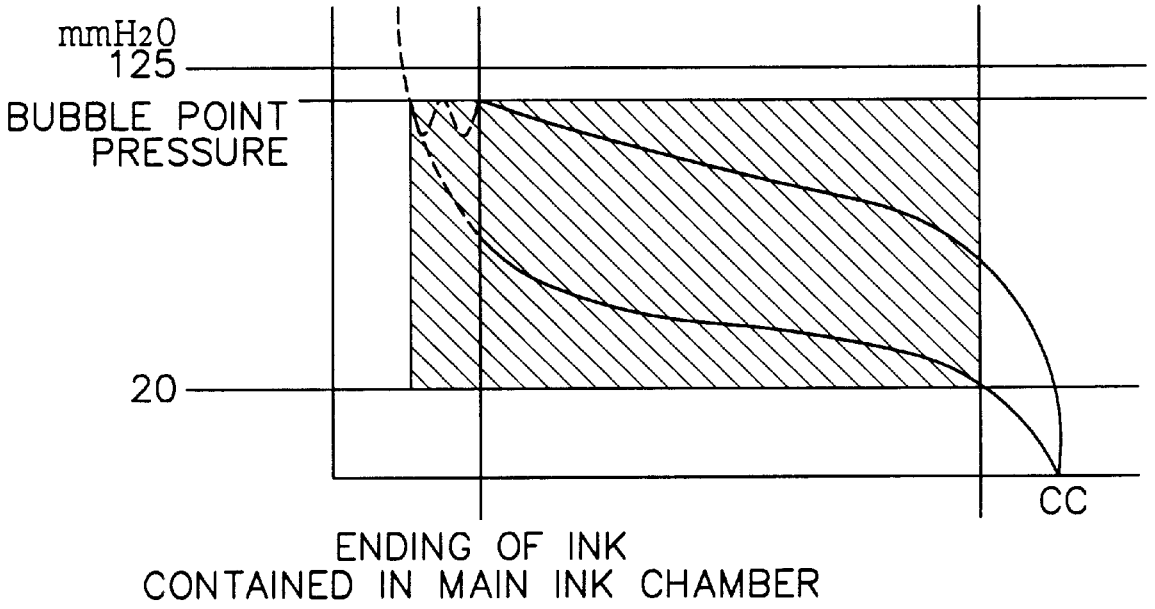
Figure 15A:
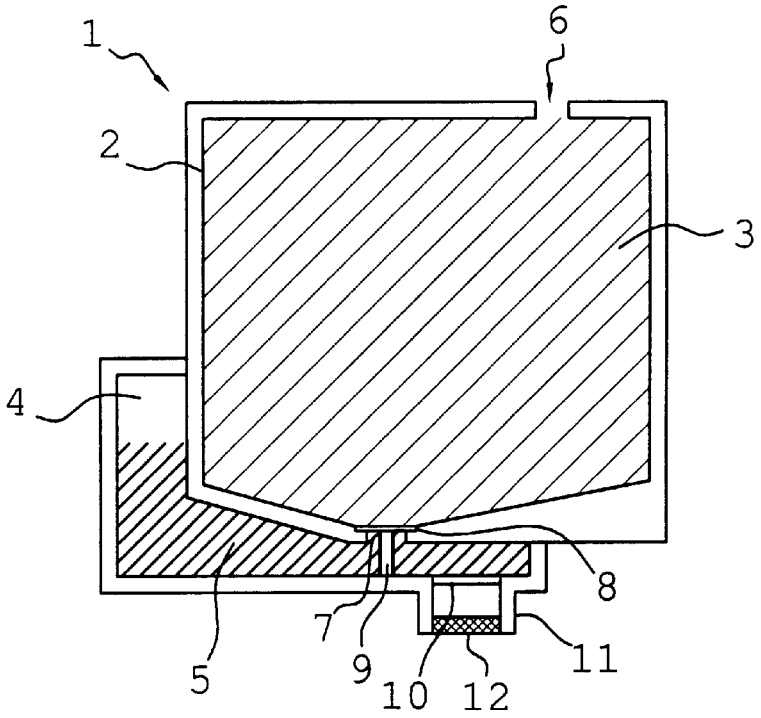
FIGS. 15A and 15B are explanatory diagrams for indicating such a condition that the bubbles are accumulated in the intermediate ink chamber of the ink tank in the ink tank operations according to the first embodiment of the present invention.
Figure 15B:
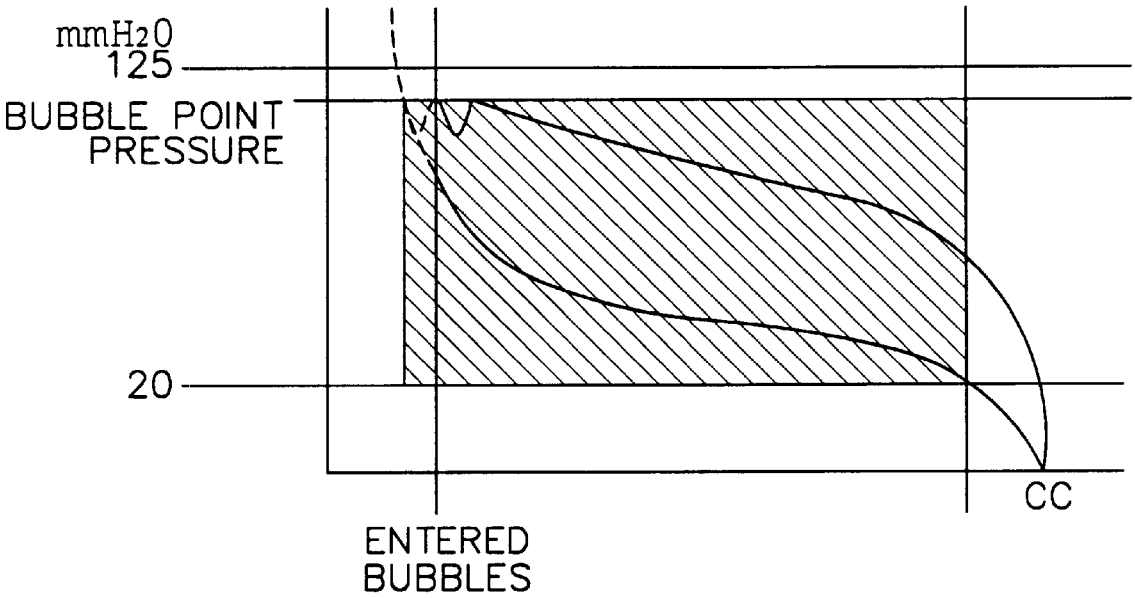
Figure 16A:
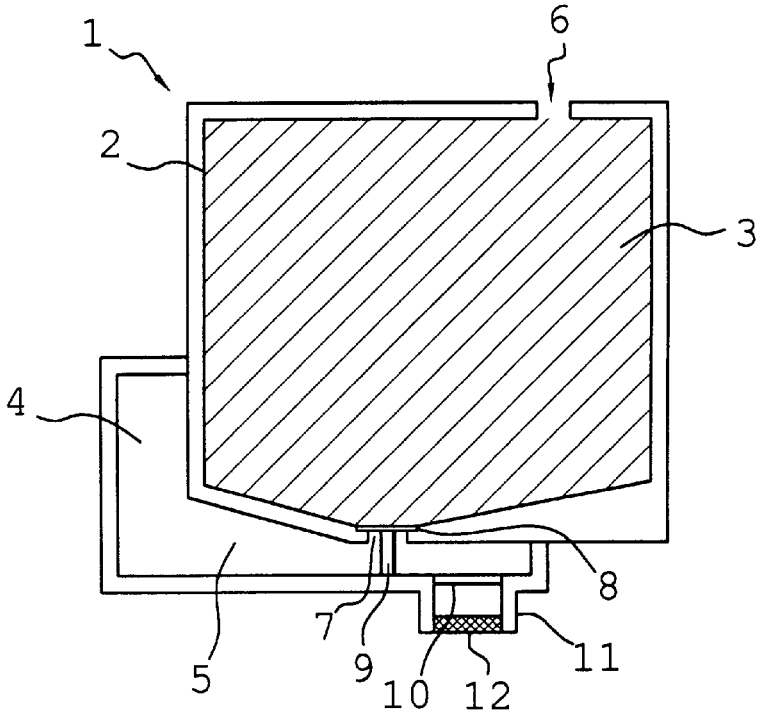
FIGS. 16A and 16B are explanatory diagrams for showing an empty condition of the ink tank according to the first embodiment of the present invention.
Figure 16B:
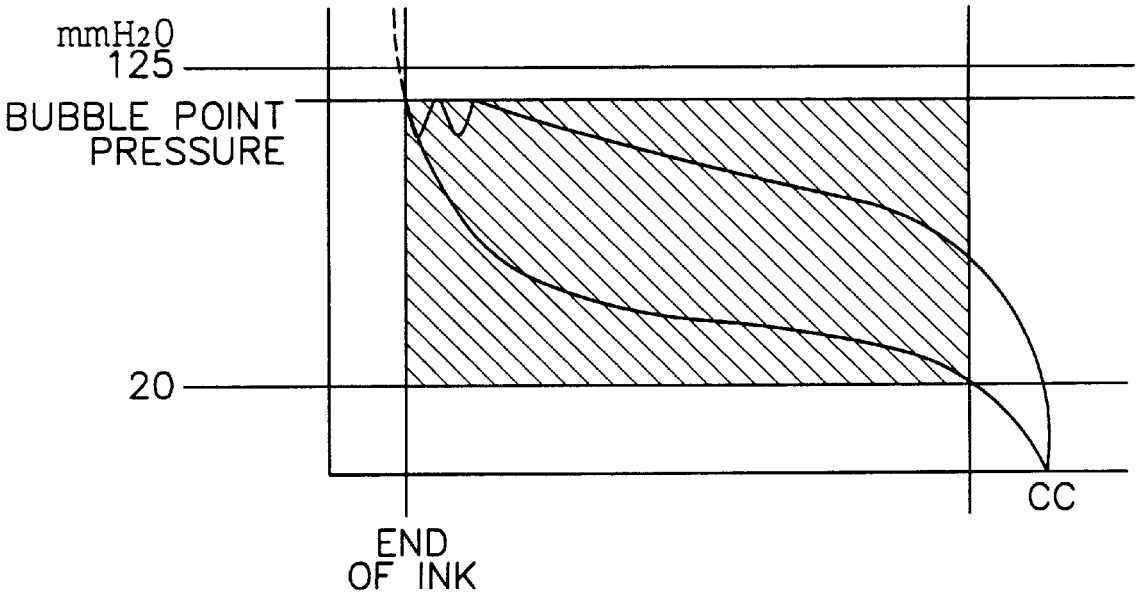

When the ink held in the capillary vessel member 3 is substantially completely depleted, it is brought into such a condition that the air is in contact with the first meniscus forming member 8. This condition is indicated in FIG. 14. Under this condition, either the boundary surface of the ink or the meniscus of the ink is formed in the very fine holes of the first meniscus forming member 8. While the ink is further consumed, when the negative pressure is gradually increased and then a certain constant negative value (namely, bubble point pressure of ink determined by filtering grain size of first meniscus forming member 8) is applied to the first meniscus forming member 8, fine air bubbles are produced on the side of the communication path 5 of the first meniscus forming member 8 through either the boundary surface of the ink or the meniscus formed on the first meniscus forming member 8. The produced fine bubbles are propagated into the inclined surface of the communication path 5 due to the buoyancy of the bubbles themselves, and thereafter are transported into the intermediate ink chamber 4. At this time, since the upper surface of the communication path 5 is inclined, the bubbles can be smoothly transported into the intermediate ink chamber 4. The bubbles which have moved into the intermediate chamber 4 are gradually reservoired into the intermediate ink chamber 4. This condition is shown in FIG. 15. Since the dynamic pressure of the ink after this ink reservoiring is controlled by the first meniscus forming member 8, this dynamic pressure can be maintained at substantially constant until the ink is depleted.

Subsequent to the condition shown in FIG. 15, both surfaces of the first meniscus forming member 8 are exposed by the air. That is, the ink within the main ink chamber 2 is depleted, so that the side of the main ink chamber 2 of the first meniscus forming member 8 is exposed to the air conducted from the atmospheric communication port 6. Similarly, a very small air layer is formed by the bubbles entered via the first meniscus forming member 8, so that the side of the communication path 5 of the first meniscus forming member 8 is exposed to the air. However, the ink present in the communication path 5 is sucked into the first meniscus forming member 8 by the ink supply unit 9, so that the first meniscus forming member 8 is continuously under wet state. As a consequence, the ink film is continuously formed in the first meniscus forming member 8, and the negative pressure produced after the bubbles are produced can be effectively controlled.

In such a case that the bubbles are conducted to the communication path 5 of the first meniscus forming member 8 irrelevant to such a fact whether of not the ink is present in the main tank chamber 2, as previously explained, the bubbles are propagated onto the inclined upper surface of the communication path 5, and transported to the intermediate ink chamber 4. The bubble transport direction at this time corresponds to such a direction from the communication hole 7 to the intermediate ink chamber 4, whereas the transport direction of the ink supplied to the print head corresponds to the direction from the communication hole 7 to the joint hole 11. As described above, the bubble transport direction is directed opposite to the ink transport direction, the ink can be firmly separated from the bubbles, so that the amounts of the bubbles mixed into the print head can be reduced.

When the bubbles are conducted from the condition shown in FIG. 14 into another condition indicated in FIG. 15, since the capacity of the intermediate ink chamber 4 is very small, the fluid surface of the intermediate ink chamber 4 is rapidly lowered. Since at least a portion of the intermediate ink chamber 4 is made of a transparent member, it is possible to detect such a condition that the ink stored in the intermediate ink chamber 4 is substantially completely depleted. In other words, while the ink is present in the main ink chamber 2, the intermediate ink chamber 4 is filled with the ink, or a very small amount of air is present therein. This condition is continued until the ink stored in the main ink chamber 2 is depleted, and this condition of the ink tank 1 is continued during substantially entire periods. However, when the ink stored in the main ink chamber 2 is depleted, the amount of the ink stored in the intermediate ink chamber 4 is rapidly lowered, it is possible that the ink is depleted. Various detecting methods may be employed, for instance, visual detecting methods, and optical detecting methods. Then, as indicated in FIG. 16, the ink supply pressure can be controlled under stable value until the ink present in the intermediate ink chamber 4 and the communication path 5 is substantially constantly depleted.

As previously explained, at least a portion of the intermediate ink chamber 4 is made of a transparent member in order to detect the remaining amount of the ink. Alternatively, the entire portion of the intermediate ink chamber 4, or the overall portion of the ink tank may be made of transparent members. When the entire portions are made by the transparent members, there are such merits that the total number of parts can be reduced, and the sealing characteristic of the intermediate ink chamber 4 may be easily achieved.

It should be noted that even under such a condition that the ink is present in the main ink chamber 2, a small amount of air is accumulated in the intermediate ink chamber 4. For instance, when a check is visually done as to whether or not the ink is present, there is such a risk that although a user visually recognizes a small layer of air and the ink is left in the main ink chamber 2, this user may recognize that no ink is present. To avoid such a problem, for example, a reference line is made at a position where the fluid surface of the intermediate ink chamber 4 does not reach while the ink is left in the main ink chamber 2. Alternatively, the upper portion of the intermediate ink chamber 4 is covered with a blind member, and a window 14 may be formed only in a region where the ink depletion should be detected.

However, when the surrounding environments are changed, for instance, the external atmospheric pressure is varied or the external temperature is changed, since the atmospheric pressure applied from the atmospheric communication port 6 to the capillary vessel member 3 is equal to the atmospheric pressure applied to the tip portion of the nozzle of the print head 1, the balance in the pressure is not changed even if the atmospheric pressure is varied, and therefore there is a very few adverse influence. In the case that the air is integrated in the intermediate ink chamber 4, the integrated air will be expanded or compressed due to the variations in the external atmospheric pressure and the external temperature. When the air within the intermediate ink chamber 4 is compressed, since the negative pressure is increased, this variation is canceled by an operation similar to such an operation when the ink is used. When the air within the intermediate ink chamber 4 is expanded, the ink present in the communication path 5 passes through the first meniscus forming member 8 and is absorbed into the capillary vessel member 3, so that the negative pressure within the communication path 5 can be maintained. However, in any one of these cases, there is a small amount of air existing in the intermediate ink chamber 4. Also, since the capacity of the main ink chamber 2 is considerably larger than that of the intermediate ink chamber 4, there is no specific problem.

Figure 17:
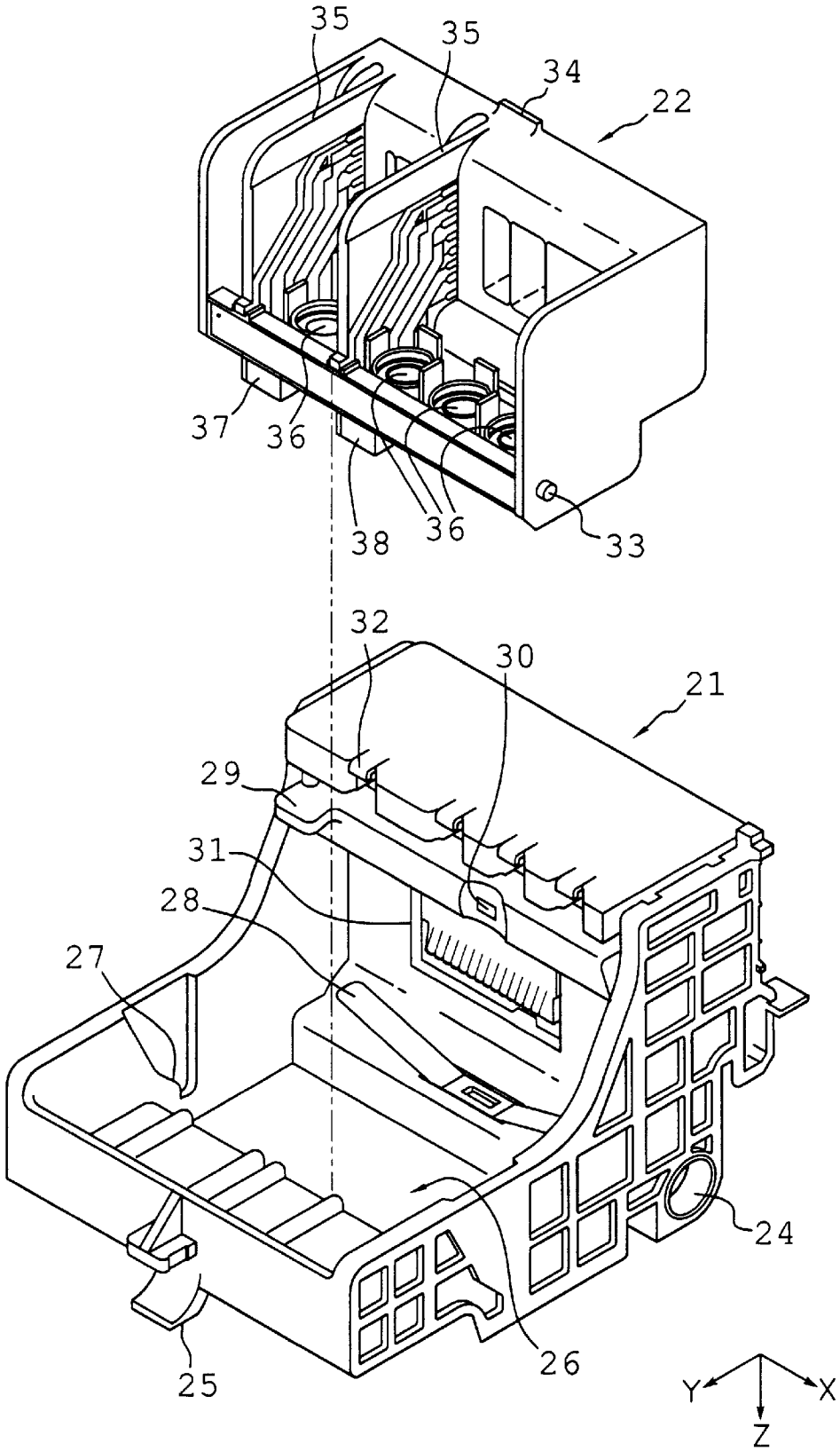
FIG. 17 is a perspective view for indicating a condition of a carriage portion before being mounted on a print head unit in the ink tank according to the first embodiment of the present invention.
Figure 18:
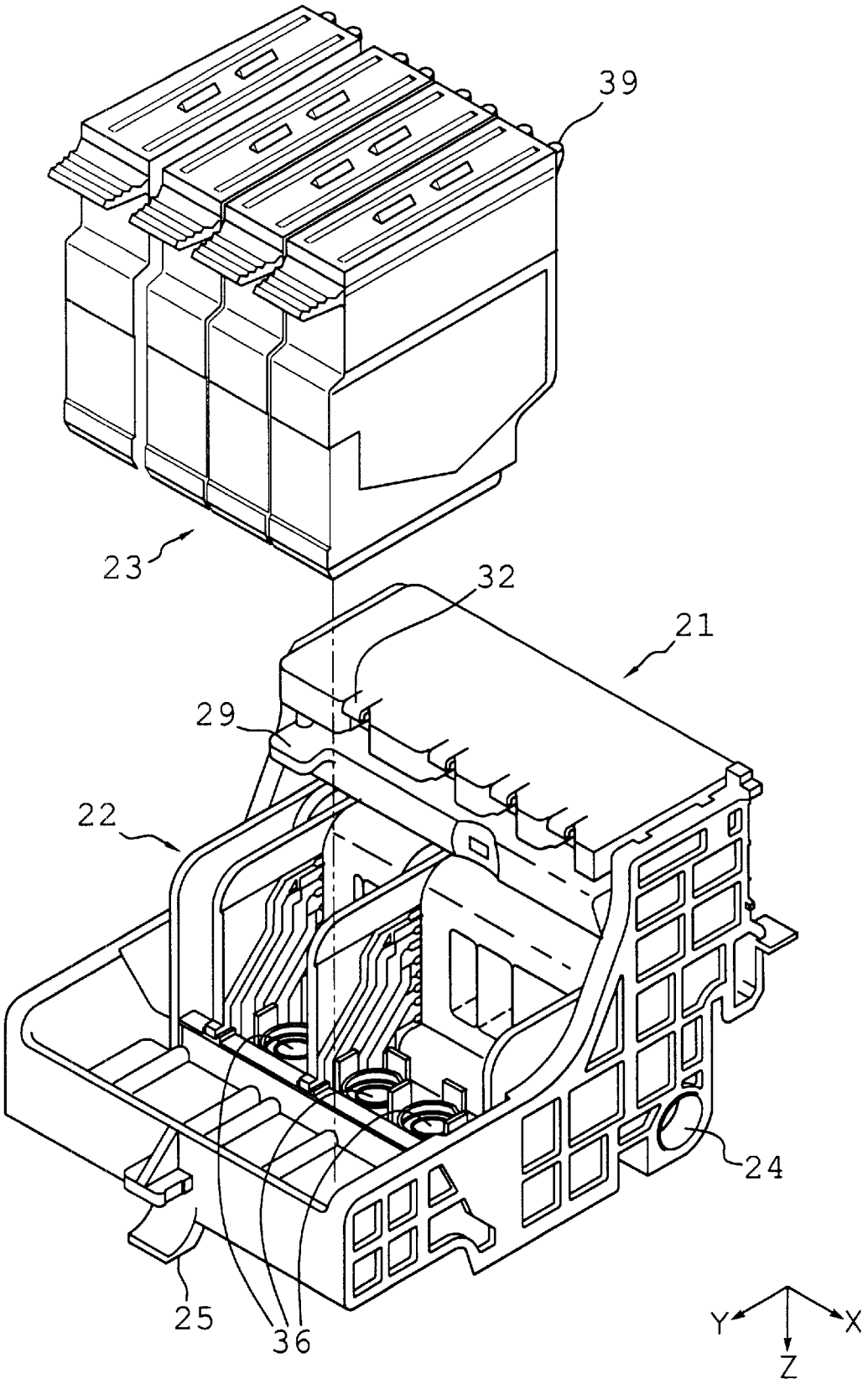
FIG. 18 is a perspective view for indicating a condition of the carriage portion before the ink tank is mounted in the ink tank according to the first embodiment of the present invention.
Figure 20:
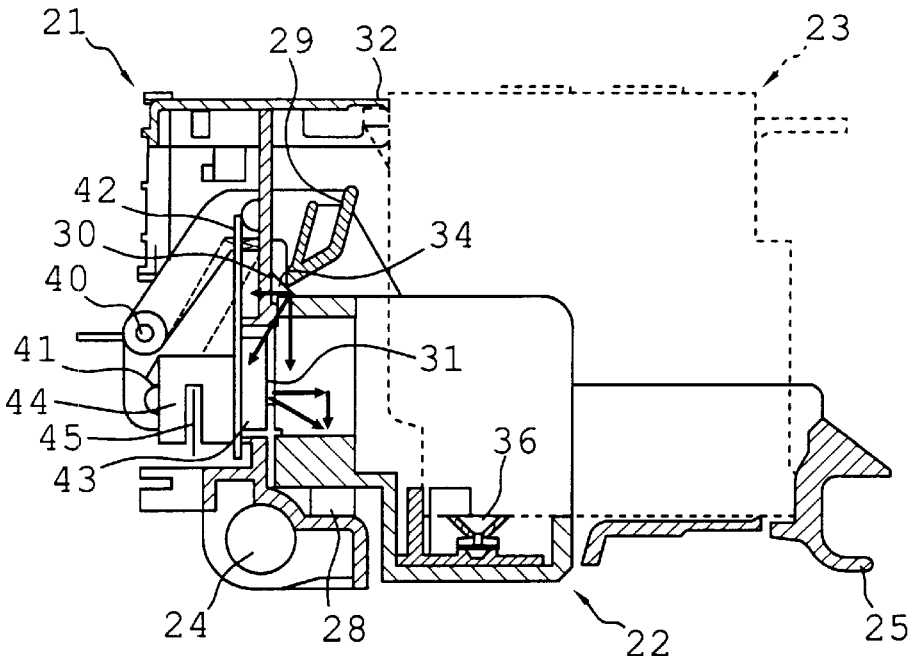
FIG. 20 is a sectional view for indicating a condition of the carriage portion after the ink tank is mounted in the ink tank according to the first embodiment of the present invention.

FIG. 17 to FIG. 19 are perspective views for representing one example of a carriage portion on which the ink tank according to the first embodiment of the present invention is mounted. FIG. 20 is a sectional view for similarly representing this carriage portion. Also, the ink tank according to the second embodiment is similarly mounted on this carriage. In the drawings, reference numeral 21 shows a carriage, reference numeral 22 denotes a print head unit, reference numeral 23 denotes an ink tank, reference numeral 24 shows a shaft hole, and reference numeral 25 indicates a guide blade receiver. Also, reference numeral 26 is an opening, reference numeral 27 indicates a projection receiver, reference numeral 28 shows a leaf spring, reference numeral 29 is a print head depressing lever, and reference numeral 30 denotes a print head abutting portion. Furthermore, reference numeral 31 shows a contact pin, reference numeral 32 indicates an ink tank pushing member, reference numeral 33 represents a projection, reference numeral 34 denotes a print head fixing unit, reference numeral 35 is a base plate, reference numeral 36 shows an ink conducting unit, reference numeral 37 is a head for black ink, reference numeral 38 shows a head for color ink, and reference numeral 39 denotes an engaging portion. Also, reference numeral 40 is a shaft, reference numeral 41 shows a spring, reference numeral 42 represents a contact board, reference numeral 43 is a connector, reference numeral 44 shows a position sensor, and reference numeral 45 is a timing fence.

On the carriage 21, the shaft hole 24 and the guide plate receiver 25 are provided, and are so arranged that these member can be transported by the main shaft and the guide plate of the main body of the recording apparatus. To assemble the print head unit 22, the opening 26 is formed at a center portion of the carriage 21, the projection receiver 27 is provided on both side walls, and the leaf spring 28 is provided on the bottom surface of the rear portion. The print head depressing lever 29 is pivotably fixed to the shaft 40 at their both ends, and is energized by the spring 41, as shown in FIG. 20. As indicated by a wide arrow of FIG. 20, when the print head unit 22 is mounted, the print head depressing lever 29 depresses the print head unit 22 against the print head abutting portion 30 along the oblique direction so as to energize this print head unit 22 along the Z direction and −Y direction (see FIG. 20). When the print head unit 22 is mounted the print head abutting unit 30 abuts against the print head fixing unit 34 of the print head unit 22, so that the print head unit 22 is positioned. In FIG. 17, there is shown such that a portion of the print head depressing lever 29 is cut away and the print head abutting portion 30 provided therein can be observed.

As indicated in FIG. 20, the contact board 42 is provided on the rear surface of the carriage 21, and is electrically connected to the main body of the recording apparatus via the flexible cable. The connector 43 is mounted on this contact board 43. The contact pin 31 of the connector 43 is such a portion used to be electrically connected to the print head unit 22. This contact pin 31 may supply the electric power and various sorts of signals supplied from the main-body of the recording apparatus to the print head unit 22. The position sensor 44 is further provided on the contact substrate 42, which may sense the mark made on the timing fence 45.

The ink tank pushing member 32 is engaged with the engaging unit 39 of the ink tank 23 to stop the ink tank 23. In response to the depressing force of this ink tank pushing member 32, the ink tank 23 is depressed against to the ink conducting portion 36 of the print head unit 22 to thereby tightly close the connection portion between the ink tank 23 and the print head unit 22, so that a fluid communication can be established. The portion near this ink tank pushing member 32 is concaved by a size equal to the width of the engaging portion 39. The positioning operations along the X-direction and the Y-direction in this drawing are carried out by inserting the engaging portion 39 into this concave.

In the print head unit 22, such ink conducting portions 36 connected to the respective ink tanks 23 in the fluid manner, for receiving the ink supplied thereto are provided in the respective colors. In this case, these are provided the ink conducting portions 36 for receiving the black ink and the other three color ink. The black ink is supplied to the black color ink 37 and the other color ink is supplied to the color ink heads 38 among the ink received by this ink conducting unit 36. A large number of nozzles are arranged along the Y direction of this drawing in the black ink head 37 and the color ink heads 38. In the black ink head 37, the recording operation in the black color can be done by employing all of the arranged nozzles. In the color ink head 38, the arranged nozzles are subdivided into three groups, and the printing operations in the respective colors are performed by employing the nozzles belonging to the respective subdivided groups. An unused nozzle may be provided.

On the other hand, drive circuits for driving the black ink head 37 and the color ink head 38 are arranged with employment of the board 35 electrically connected to the contact pin 31 of the carriage 21. In this case, two sheets of boards 35 are employed in correspondence with the respective print heads. The board 35 may be made of a metal, for instance, and may be employed as heat sinks for radiating heat of the black ink head 37 and of the color ink head 38. The projection 33 is provided on the side surface of the print head unit 22, and the print head fixing unit 34 is provided at the upper portion thereof. This print head fixing unit 34 is used when it is mounted on the carriage 21. The projection 33 is engaged with the projection receiver 27 of the carriage 21, by which the print head unit 22 is held and the positioning operation thereof is performed. The print head fixing unit 34 abuts against the print head abutting unit 30 of the carriage 21, and is depressed to be fixed by the print head pushing lever 29.

When the print head unit 22 is mounted on the carriage 21, the print head unit pushing lever 29 is pivoted in such a manner that this pushing lever 29 is picked up. On the other hand, the print head unit 22 is inserted from the upper portion of the carriage 21 in such a way that the black ink head 37 and the color ink head 38 of the print head unit 22 are exposed from the opening 26 of the carriage 21. At this time, when the print head unit 22 is inserted along a slightly inclined direction, this print head unit 22 can be easily inserted. Thus, the projection 33 of the print head unit 22 is inserted into the projection receiver 27 of the carriage 21 and then abuts against the deepmost portion thereof, so that the positioning operation of the print head unit 22 with respect to the front side is performed. Furthermore, the print head fixing unit 34 of the print head unit 22 abuts against the print head abutting portion 30 of the carriage 21, so that the print head depressing lever 29 is removed, and the carriage 21 is depressed along the Z direction and the −Y direction by way of the energizing force of the print pushing lever 29. The force directions at this time are indicated by wide arrows of FIG. 20. On the other hand, the print head unit 22 is mounted on the leaf spring 28 of the carriage 21, and is energized along the −Z direction in response to this elastic force, so that the print head unit 22 is fixed together with the print head depressing lever 29.

Furthermore, the contact pin 31 of the carriage 21 is electrically connected to the contact portion of the print head unit 22 (not shown). At this time, to achieve the stable electric connection, the contact pin 31 requires the depressing force against the contact portion of the print head unit 22 side. Also, the reaction force of the respective contact pins 31 requires approximately 80 gf at this time. For instance, assuming now that the number of signal lines is 15, the reaction force of the contact pin 31 requires approximately 1.2 Kgf in total. After the projection 22 of the print head unit 22 has been inserted into the projection receiver 27 of the carriage 21, the print head unit 22 is fixed by way of the print head depressing lever 29 of the carriage, so that the contact unit of the print head unit 22 is depressed to the contact pin 31 by a preselected force, and therefore the stable electric coupling can be achieved. In FIG. 20, this depressing force by the contact pin 31 is indicated by the wide arrow.

Generally speaking, in the case that a certain component is positioned so as to be assembled, when this component is positioned at 3 points in a first reference plane, at 2 points in a second reference plane, and at 1 point in a third reference plane, it is well known that the most stable arrangement can be obtained. In this arrangement, the positioning operation is carried out by the print head fixing portion 34 of the print head unit 22 and the print head abutting portion 30 of the carriage 21, and also the positioning operation is performed by the projections 33 located on both sides of the print head unit 22 and the projection receivers 27 located on both sides of the carriage 21 as to the Y direction. To carry out these positioning operations, the depressing force by the print head depressing lever 29 and the reaction force of the contact pin 31 are utilized. The print head depressing lever 29 produces the force along the directions from the Z direction to the −Y direction at angle of about 30 degrees. Then, this print head depressing lever 29 depresses. The print head unit 22 along the Z direction and the −Y direction to firmly achieve the abutment between the print head fixing portion 34 of the print head unit 22 and the print head abutting portion 30 of the carriage 21 for the positioning purpose. Also, the print head depressing lever 29 depresses the projections 33 of the print head unit 22 against the bottommost portion of the projection receivers 27 of the carriage 21 to thereby performing the positioning operation along the Z direction. Furthermore, the projection 33 of the print head unit 22 are depressed against the projection receivers 27 of the carriage 21 under stable condition along the Y direction by way of the reaction force exerted by the contact pin 31, so that the positioning operation along the Y direction at this portion can be done. As described above, the positioning operations along the Y direction and the Z direction may be carried out in higher precision. It should be noted that the positioning operation along the X direction may be performed by the projections 33 and the side surface of the carriage 21.

FIG. 18 represents such a condition that the print head unit 22 is assembled to the carriage 21. After the print head unit 22 has been assembled to the carriage 21, the ink tank 23 is mounted. In this case, the black ink tank and other three color ink tanks are mounted. As these ink tanks, the above-described ink tanks of the preferred embodiment may be employed. The engaging portion 39 is provided with each of the ink tanks 23. When the ink tank 23 is mounted, this ink tank 23 is inserted into a preselected position while grasping the handle portion of the ink tank 23. Then, the engaging portion 39 of the ink tank 23 is fitted to the ink tank pushing member 30 of the carriage 21, and the pressure is applied to the ink tank 23 against the print head unit 23 along the Z direction. Upon receipt of this pressure application, the joint port located at the lower surface of the ink tank 23 is made in contact with the respective ink conducting portions 36 of the print head unit 22, so that a highly closed ink flow path is fabricated.

Also, the lower portion of the front surface of the ink tank 23 abuts against the front portion of the carriage so as to perform the positioning operation along the Y direction. This positioning along the Y direction is also performed by the wall provided at the depth corner of the ink conducting portion 36 of the print head unit 22, and also the concave provided near the ink tank push member 30 of the carriage 21. Furthermore, the positioning operation along the X direction is also performed by the isolation wall formed around the ink conducting portion 36 of the print head unit 22 and the concave provided near the ink tank pushing member 30 of the carriage 21. In this example, a pawl is formed on the surface of the carriage 21, located opposite to the bottom surface of the ink tank 23. The ink tank 23 may be also depressed to be fixed by this pawl. In FIG. 19, there is shown such a condition that the four ink tanks 23 are mounted.

Figure 21:
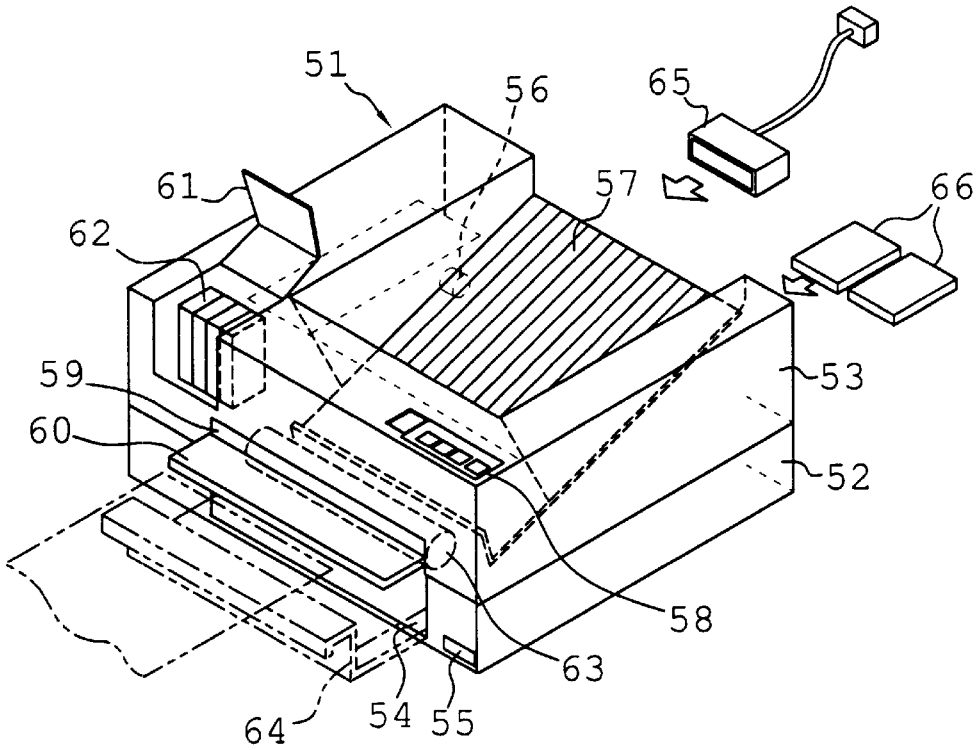
FIG. 21 is an outer view for indicating one example of a recording apparatus according to the present invention.

FIG. 21 is an outer view for showing one example of a recording apparatus. In this drawing, reference numeral 51 shows a recording apparatus, reference numeral 52 indicates a lower case, reference numeral 53 denotes an upper case, reference numeral 54 is a tray inserting port, and reference numeral 55 represents a dip switch. Reference numeral 56 is a main switch, reference numeral 57 represents a paper receiver, reference numeral 58 denotes a panel console, reference numeral 59 is a hand supply insert port, reference numeral 60 denotes a hand delivery tray, reference numeral 61 represents an ink tank inserting lid, reference numeral 62 shows an ink tank, reference numeral 63 indicates a paper feed roller, reference numeral 64 represents a paper tray, reference numeral 65 is an interface case, and reference numeral 66 shows a memory card.

A housing of the recording apparatus 51 is mainly constructed of a lower case 52 and an upper case 53. An electric circuit (not shown) and a drive system component (not shown either) are stored in this housing. The tray inserting port 54 is provided with the lower case 52, through which the paper tray 64 for storing therein a recording paper is inserted, so that the recording paper is set to the recording apparatus 51.

Also, the dip switch 55 and the main switch 56 are mounted on the lower case 52. The dip switch 55 is used to set a portion of the operations of the recording apparatus 51, and thus the functions which are not frequently changed are allocated to the dip switch 55. This dip switch 55 is so arranged as to be covered during no use condition. The main switch 56 is such a switch for turning ON/OFF the power supply of the recording apparatus 51. Furthermore, an interface connector (not shown) and the insert port of the memory card 66 are provided in the lower case 52. The interface cable 65 is connected to the interface connector so as to transmit/receive data to/from an external computer. The memory card 66 may be employed as an expanded memory while the recording apparatus 51 is operated, and fonts are stored into this memory card 66 in order to be used during the recording operation.

The paper receiver 57 is formed n the upper case, into which the recorded paper is ejected. Also, the panel console 58 is provided with this upper case, on which input means and display means are arranged. The input means is frequently used by the user so as to set the recording mode and also instruct the paper supply and the paper ejection. The display means displays a message supplied from the printer. Furthermore, the hand inserting port 59 and the hand delivery tray 60 are provided on the upper case 53, through which the user can manually supply the paper.

The ink tank inserting lid 61 is provided with the upper case 53. The ink tank 62 can be mounted/removed by opening this lid, which is present within the upper case 53. As the ink tank 62, the ink tanks as explained in the respective embodiments of the present invention may be employed. In this case, the four ink tanks are mounted. As indicated in FIG. 17 through FIG. 20, the print head unit is mounted on the carriage, and furthermore, the ink tank 62 is mounted.

The paper stored in the paper tray 64 is transported one by one by way of an internal transport system (not shown) to be fed along the circumference of the paper feed roller 68. The print head (not shown in detail) on which the ink tank 62 is mounted is moved along a direction perpendicular to the transport direction of the paper, so that the printing operation is carried out with respect to each of band-shaped regions. Then, the paper is transferred along the longitudinal direction of this paper up to the next recording (printing) position having the band shape. Such an operation is repeatedly performed to perform the recording operation on the paper. Then, the printed paper is ejected onto the paper receiver 57 of the upper case 53.

In the above-described FIG. 17 to FIG. 21, there are shown the arrangements when the black ink and other three-color ink are employed to perform the recording operation. At this time, since the use frequency of the black ink is higher than that of other three-color ink, the capacity of the black ink may be made larger than the capacities of other three-color ink. Alternatively, it may be so arranged that only the three-color ink other than the black color ink may be employed, or more than 5 ink supply systems may be employed. Apparently, the present invention may be applied to a monochromatic recording apparatus. Furthermore, another arrangement may be employed in which print heads are provided with respect to the respective colors, other than the above-explained arrangements shown in FIG. 17 to FIG. 20 in which the black ink head 37 and two sets of the color ink heads 38. Obviously, the ink tank according to the present invention may be applied to various types of recording apparatuses in which while the recording medium is fixed, the recording head is transported along the X and Y directions, in addition to the above-explained recording apparatus where the recording operation is carried out while transporting the recording medium along the sub-scanning direction.

It should be understood that various modifications may be achieved in the above-described embodiments. First, both the atmospheric communication port 6 and the groove 14 in which the atmospheric communication port 6 is formed may be provided on not only the upper surface of the main ink chamber 2, but also other surfaces such as the side surface thereof. In this case, the capillary vessel member 3 is not in contact with the side surface under pressure, in which the atmospheric communication port 6 is provided. Also, the position of the communication holes 7 is not limited to the bottom surface of the main ink chamber 2, but may be formed on the side surface. At this time, if the atmospheric communication port 6 and the groove 14 are provided on the surface opposite to the surface where the communication holes 7 are formed, and furthermore are provided on such a surface whose interval is wide, then the ink may flow along one direction and thus there is a few place where the ink is reservoired. Accordingly, the ink can be effectively used. For example, in the case that the ink tank indicated in FIG. 1 is employed with being reversed, the above-explained shape may be achieved.

In the above-described embodiment, the atmospheric port 6 and the groove 14 are formed in the lid 13, but the present invention is not limited thereto. Since the ink tank 1 owns such internal spaces as the main tank chamber 2 and the intermediate ink chamber 4, this ink tank 1 should be arranged by a plurality of members. Alternatively, for example, in the case that both the atmospheric communication port 6 and the groove 14 are formed in the upper surface of the main ink chamber 2, the lid 13 may be formed on the side surface or the bottom surface. As previously explained, when the lid 13 is formed on the upper surface of the main ink chamber 2, the atmospheric communication port 6 and the groove 14 may be formed in the side surface.

Furthermore, the shape of the ink tank is the rectangular solid form in the above-explained embodiments. Alternatively, various shapes of the ink tanks may be arranged, for instance, a circular cylinder shape, a pyramid shape, and a doughnut shape. Moreover, the print head is separatably provided with the ink tank in the above-described embodiment, but the present invention is not limited thereto. Alternatively, the present invention may be applied to another case that the print head and the ink tank are formed in an integral form.

As apparent from the foregoing descriptions, according to the present invention, since the concave is formed in the peripheral surface containing the atmospheric communication port, the atmospheric air can be properly supplied to the capillary vessel member provided in the ink chamber. Accordingly, the amount of ink remaining in the capillary vessel member is reduced, and the ink contained in the capillary vessel member employed in the ink chamber can be utilized in the maximum efficiency. As a consequence, there is such an advantage that the using efficiency of the ink contained in the ink tank can be improved.

Figure 22:
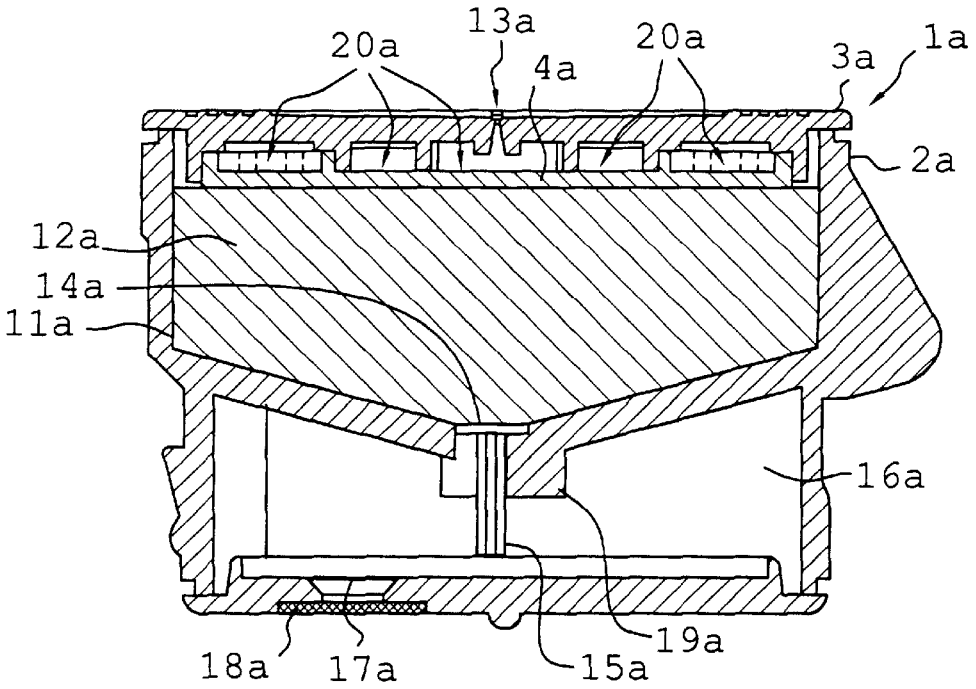
FIG. 22 is a cross-sectional view showing one embodiment of an ink tank in accordance with the present invention.

Further, FIG. 22 is a cross-sectional view showing one embodiment of an ink tank in accordance with the present invention. In the drawing, reference numeral 1*a* designates an ink tank; 2*a* designates a housing; 3*a* designates a cover; 4*a* designates a guard member; 11*a* designates a main tank chamber; 12*a* designates an ink-impregnated member; 13*a* designates an atmospheric communication hole; 14*a* designates a first meniscus formation member; 15*a* designates an ink guide member; 16*a* designates an intermediate chamber; 17*a* designates a second meniscus formation member; 18*a* designates a joint capillary tube member; 19*a* designates an ink guide member presser; and 20*a* designates an air chamber.

The inside of the ink tank 1*a* is partitioned into the main tank chamber 11*a* and the intermediate chamber 16*a* provided below the main tank chamber, and the ink-impregnated member 12*a* is provided in the main ink chamber 11*a*. The ink-impregnated member 12*a* holds ink by capillary attraction and is maintained under negative pressure. An assembly consisting of the cover 3*a* and the guard member 4*a* is fused to the housing 2*a* in the vicinity of an upper portion of the main ink chamber 11*a*. The atmospheric communication hole 13*a* is formed in the cover 3*a*, and one or more air chamber 20*a* are formed as a result of the cover 3*a* being fused to the guard member 4*a*. The adjacent air chambers 20*a* are connected to each other as well as to the atmospheric communication hole 13*a* and the main ink chamber 11*a*. The air introduced from the atmospheric communication hole 13*a* enters the main ink chamber 11*a* through the one or more air chambers 20*a*. Since an upper portion of the ink-impregnated member 12*a* is communicated with the atmosphere via the air chambers 20*a*, the ink-impregnated member 12*a* is held under the ambient pressure. The ink held in the ink-impregnated member 12*a* is pushed under the ambient pressure at the time of ink supply, and the thus-pushed ink is drawn into the intermediate chamber 16*a* from a lower portion of the ink-impregnated member 12*a* by the negative pressure. The bottom of the main ink chamber 11*a* is tapered off to a communication hole.

The first meniscus formation section 14*a* having a plurality of minute pores is provided between the main ink chamber 11*a* and the intermediate chamber 16*a*. The bottom of the ink-impregnated member 12*a* is brought into pressed contact with the first meniscus formation member 14*a*. When the ink-impregnated member 12*a* is impregnated with ink, the ink migrates to the intermediate chamber 16*a* through the first meniscus formation member 14*a*. In contrast, if the ink-impregnated member 12*a* becomes empty of ink, the meniscus of ink formed on the minute pores of the first meniscus formation member 14*a* which is in contact with the ink-impregnated member 12*a* is pressed under the ambient pressure, so that air passes through the meniscus formation member 14*a* in defiance of surface tension. The thus-entered air migrates to the intermediate chamber 16*a* in the form of air bubbles. As a result, the pressure under which the ink is supplied to a print head is maintained at predetermined pressure or less.

The ink guide member 15*a* is provided below the first meniscus formation section 14*a* so as to extend to the bottom of the intermediate chamber 16*a*. This ink guide member 15*a* is supported by the ink guide member presser 19*a* which protrudes from a wall surface around the communication hole. Alternatively, a part of the first meniscus formation member 14*a* may be formed into the ink guide member 15*a*. When air bubbles build up along the lower surface of the first meniscus formation member 14*a* to thereby form an air layer or the level of the ink stored in the intermediate chamber 16*a* decreases, the ink guide member 15*a* sucks the ink from the intermediate chamber 16*a* and supplies the thus-sucked ink to the first meniscus formation member 14*a*. As a result, the first meniscus formation member 14*a* is held in a wet state under a negative pressure at all times. Accordingly, the ink supply pressure can be optimally maintained until the ink is fully expended.

Part of the intermediate chamber 16*a* extends in an upward direction beyond the communication hole. In FIG. 22, the upper wall of the intermediate chamber 16*a* is graded in such a way that the peripheral portion of the intermediate chamber 16*a* becomes located higher than the communication hole. As a result, air bubbles entered the intermediate chamber 16*a* through the first meniscus formation member 14*a* and the second meniscus formation member 17*a* are collected in the peripheral portion located higher than the communication hole to thereby prevent the air bubbles from entering the print head. Further, the air that remains in the space of the joint between the print head and the ink tank 1*a* is eliminated.

A joint is provided in the bottom of the intermediate chamber 16*a* for the purpose of connection to the print head. The second meniscus formation member 17*a* and the joint capillary tube member 18*a* are provided in this order in the joint. In the state in which the ink tank 1*a* is disconnected from the print head and left as is, the surface tension of the ink formed across the minute pores in the second meniscus member 17*a* prevents the ink from leaking from the intermediate chamber 16*a* by way of the joint. Further, in the state in which the ink tank 1*a* is connected to the print head, the surface tension prevents the ink tank 1*a* from being subjected to vibration, physical shock, or variations in pressure due to acceleration or prevents air bubbles from entering the ink tank 1*a*. When the ink tank 1*a* is fitted to the print head, the joint capillary tube member 18*a* fills the gap between the second meniscus formation member 17*a* and the print head. As a result, the amount of the air left in the joint can be significantly reduced, which in turn enables a reduction in print failures due to air bubbles. In contrast, when the ink tank 1*a* is disconnected from the print head, the joint capillary tube member 18*a* absorbs the ink to thereby prevent the leakage of ink.

Figure 23:
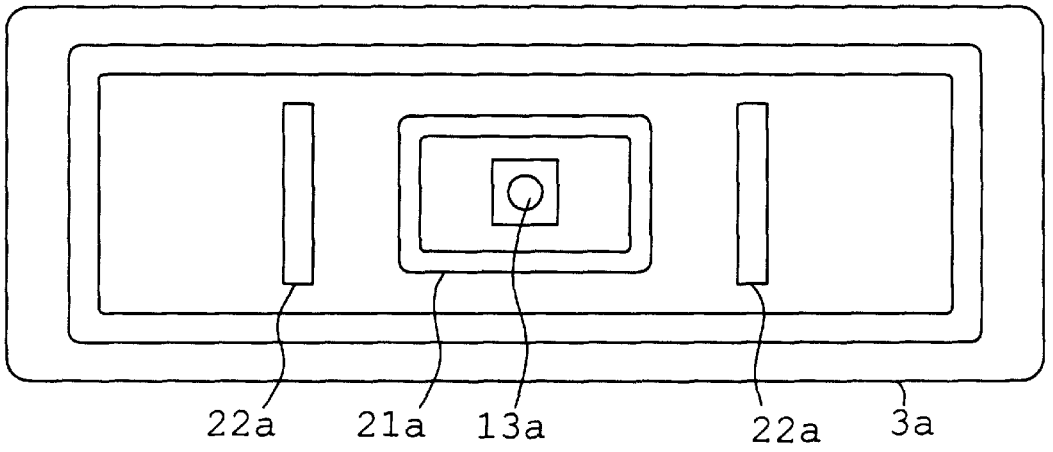
FIG. 23 is a plan view showing one example of a cover.
Figure 24:
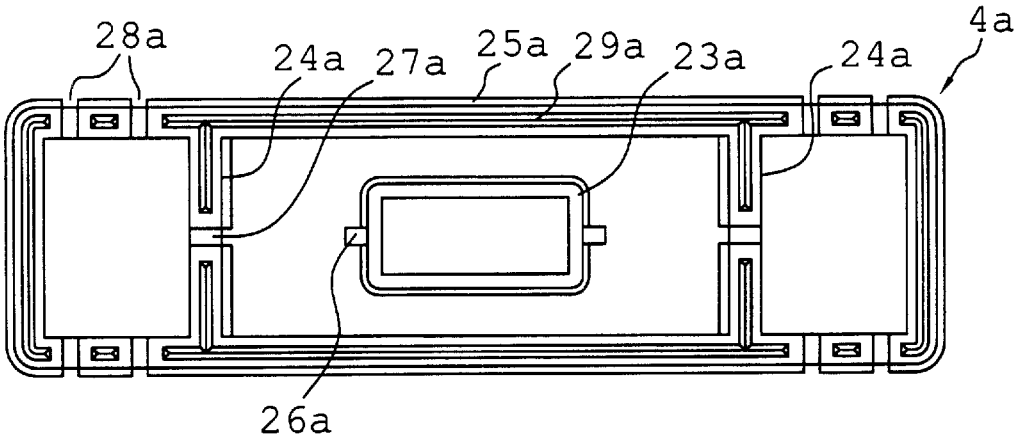
FIG. 24 is a plan view showing one example of a guard member.
Figure 25A:
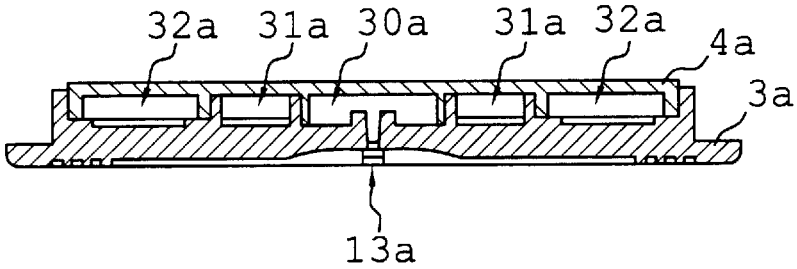
FIG. 25A is a cross-sectional view showing one example of an assembly consisting of the cover and the guard member.
Figure 25B:
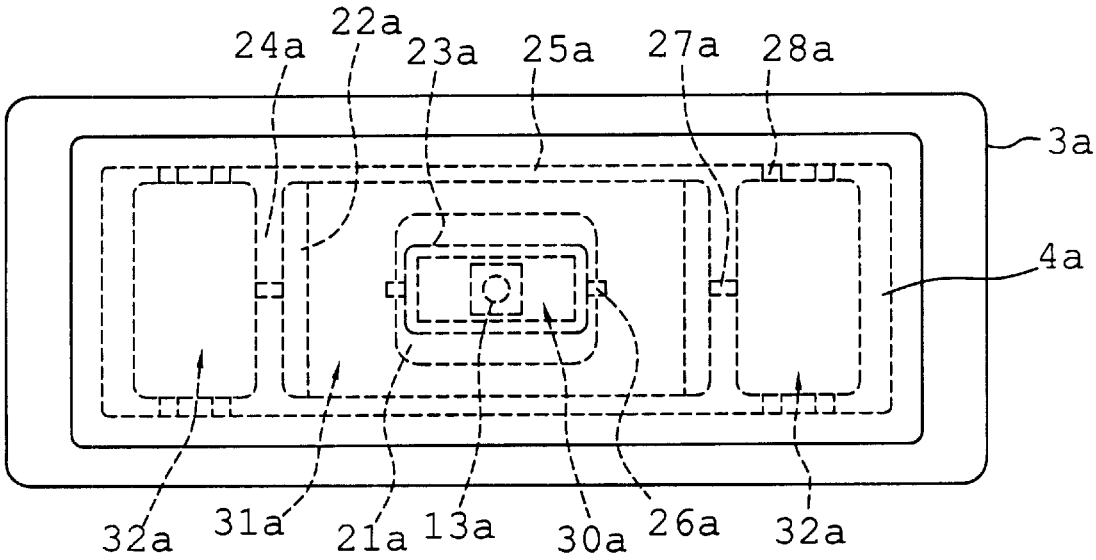
FIG. 25B is a plan view showing the assembly.

FIG. 23 is a plan view showing one example of the cover 3*a*, and FIG. 24 is a plan view showing one example of the guard member 4*a*. FIG. 25A is a cross-sectional view showing one example of the assembly consisting of the cover 3*a* and the guard member 4*a*, and FIG. 25B is a plan view of the assembly shown in FIG. 25A. The elements which are the same as those shown in FIG. 22 are assigned the same reference numerals, and their explanations will be omitted. Reference numerals 21*a* to 24*a* designate partitions; 25*a* designates a wall; 26*a* to 28*a* designate communication channels; 29*a* designates a margin fusing purposes; and 30*a* to 32*a* designate air chambers. These drawings illustrate an example of the construction of the assembly in which the air entered from the atmospheric communication hole 13*a* via the air chamber 3*a* flows into the main ink chamber 11*a*. For the sake of clarity, FIG. 24 is slightly enlarged in comparison with FIGS. 23 and 25.

As shown in FIG. 23, the partition 21*a* for partitioning the air chambers 30*a* from each other is formed around the atmospheric communication channel 13*a* on the reverse side of the cover 3*a*, and the partitions 22*a* are also formed on the reverse side for partitioning the air chamber 31*a* from the air chambers 32*a*.

As shown in FIG. 24, the guard member 4*a* has the partition 23*a* for partitioning the air chambers 30*a* from each other, the partitions 24*a* for partitioning the air chamber 31*a* from the air chambers 32*a*, and the wall 25*a* for enclosing the outer periphery of the guard member 4*a*. The communication channels 26*a* are formed in the outer periphery of the partition plate 23*a* in order to ensure an air flow channel. The communication holes 27*a* are formed in upper portions of the partitions 24*a* in order to ensure an air flow channel between the air chamber 31*a* and the air chambers 32*a*. The communication channels 28*a* are formed in the wall 25*a* in order to ensure an air flow channel between the air chambers 32*a* and the main ink chamber 11*a*. The margin 28*a* used when the cover 3*a* is fused to the guard member 4*a* is formed in the partitions 24*a* and the wall 25*a*.

As shown in FIGS. 25A and 25B, the cover 3*a* is bonded to the guard member 4*a* by, e.g., ultrasonic or heat fusing. At this time, the margin for fusing purposes 29*a* formed in the guard member 4*a* is fused to thereby bond the guard member 4*a* to the cover 3*a*. The partition 21*a* of the cover 3*a* and the partitions 24*a* of the guard member 4*a* are brought into combination as a result of the cover 3*a* being fused to the guard member 4*a*, so that the air chambers 30*a* connected to the atmospheric communication hole 13*a* are formed. Further, one air chamber 31*a* and two air chambers 32*a* are formed by combination of the partitions 22*a* of the cover 3*a* with the partitions 24*a* of the guard member 4*a* in conjunction with the wall 25*a*.

Figure 26:
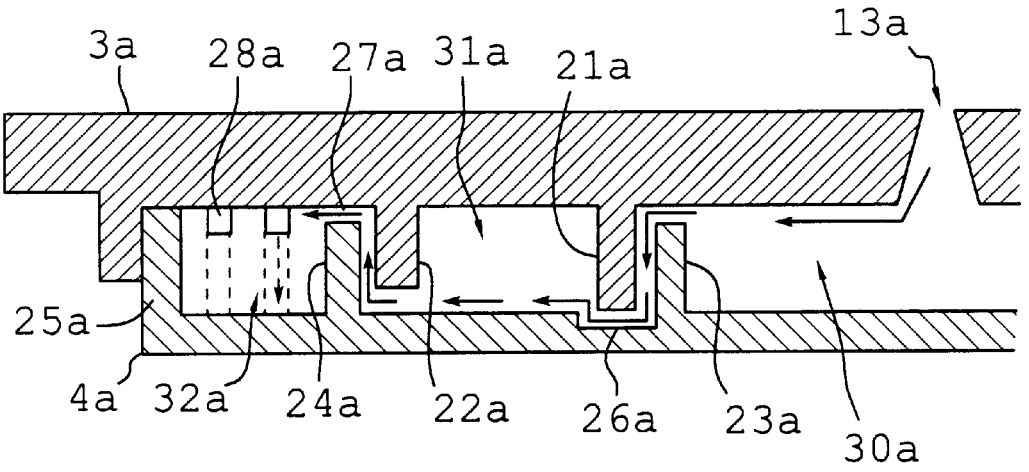
FIG. 26 is a schematic representation showing the flow of air within one example of the assembly consisting of the cover and the guard member.

FIG. 26 is a schematic representation showing the flow of air in one example of the assembly consisting of the cover and the guard member. As shown in FIG. 26, the partition 23*a* of the guard member 4*a* is not fused to the cover 3*a*, and there is a clearance between the partition 23*a* and the cover 3*a*. Further, the partition 23*a* is spaced apart from the partition 21*a* of the cover 3*a*. This partition 21*a* of the cover 3*a* is brought into contact with or fused to the guard member 4*a*, but the air flow channel is ensured by the communication channel 26*a*. With this construction, the air entered the air chambers 30*a* through the atmospheric communication hole 13*a* further enters the air chamber 31*a* by way of the clearance between the cover 3*a* and the partition 23*a*, the clearance between the partition 21*a* and the partition 23*a*, and the communication channels 26*a*.

The partitions 22*a* of the cover 3*a* are separated from the guard member 4*a* as well as from the partitions 24*a* of the guard member 4*a*. Although the partitions 24*a* of the guard member 4*a* are fused to the cover 3*a*, the air flow channel is ensured by virtue of the communication channels 27*a* formed in the partitions 24*a*. With this construction, the air inside the air chamber 31*a* enters the air chamber 32*a* by way of the clearance between the partition 22*a* of the cover 3*a* and the guard member 4*a*, the clearance between the partitions 22*a* and 24*a*, and the communication channels 27*a*.

Further, the air flow channel is ensured between the air chambers 32*a* and the main ink chamber 11*a* by virtue of the communication channels 28*a* which are formed in the wall 25*a* serving as the wall of the air chambers 32*a*. Therefore, the air inside the air chambers 32*a* can enter the main ink chamber 11*a*.

More specifically, the width of the flow channels formed between the partition 23*a* and the cover 3*a*, between the partitions 21*a* and 23*a*, between the partitions 22*a* and 24*a*, and between the partitions 22*a* and the guard member 4*a* and the depth of the communication channels 26*a* to 28*a* should preferably be set to, e.g,. about 0.2 to 0.3 mm. Further, the width of the communication channels 26*a* to 28*a* should preferably be set to, e.g., about 0.5 mm.

The air flow channels can also serve as ink flow channels. The ink held in the ink-impregnated member 12*a* may splash as a result of the ink tank being subjected to abrupt acceleration/deceleration or vibration. The thus-splashed ink enters the air flow channels as well as the ink flow channels. For example, if ink enters the communication channels 27*a* which connect the main ink chamber 11*a* to the air chambers 32*a*, the ink enters the air chambers 32*a*. However, the ink is trapped within the air chambers 32*a* and does not leak outside the ink tank. Even the ink trapped within the air chambers 32*a* splash and enter the communication channels 27*a* as a result of the ink tank being subjected to abrupt acceleration/deceleration or vibration, so that the ink enters the air chamber 31*a*. Even in this case, the leakage of ink is prevented. Further, there is the risk of the ink entering the air chambers 30*a* through the communication channels 26*a* and leaking from the atmospheric communication hole 13*a*. In practice, the ink does not enter the air chambers 30*a*, and it is very rare for the ink to enter the air chamber 31*a*. The leakage of ink is not ascertained. As described above, the leakage of ink can be prevented by the presence of the air chambers.

In this example, one air chamber 32*a* connected to the main ink chamber 11*a* is provided on each side of the air chamber 31*a*, and the plurality of communication channels 28*a* are formed so as to connect the air chambers 32*a* to the main ink chamber 11*a*. With these communication channels 28*a*, even if ink chokes up some of the communication channels 28*a*, air can be supplied to the main ink chamber 11*a* via the remaining communication channels 28*a*, thereby enabling the main ink chamber 11*a* to be held under negative pressure. Similarly, with the plurality of air chambers 32*a*, even if ink renders some of the air chambers 32*a* inoperative, the air can be supplied to the main ink chamber 11*a* via the remaining air chamber.

Since it is very rare for ink to enter the air chambers 30*a* and 31*a*, the air chambers 30*a* and 31*a* are each made up of a single chamber. As a matter of course, they may be each made up of a plurality of air chambers. Further, since the entry of ink into the air chambers 30*a* as previously described, the air chambers 30*a* may be formed into two chambers instead of into three rooms. Alternatively, the air chambers 30*a* may be partitioned into four or more chambers. The profile of the air chambers 30*a* to 32*a* is arbitrary, and only one example of the profile of these air chambers in this embodiment. The number of communication channels 26*a* to 28*a* is also arbitrary and may be determined at the time of designing. The partitions 21*a* to 24*a* do come into contact with the cover 3*a* and the guard member 4*a*. Therefore, it is possible to adopt either a method of forming air flow channels by separating the partitions away from either the cover 3*a* or the guard member 4*a* or a method of forming air flow channels by means of the communication channels. Alternatively, the pair of partitions 21*a* and 23*a* and the pair of partitions 22*a* and 24*a* are brought into close contact with each other, and air flow channels may be ensured by forming a communication channel in both or one of the partitions of each partition pair. Although the pair of partitions 21*a* and 23*a* and the pair of partitions 22*a* and 24*a* are arranged in combination in the foregoing example, it will be sufficient to arrange one of the two pairs in combination.

If the assembly consisting of the cover 3*a* and the guard member 4*a* having the foregoing construction is bonded to the housing 2*a* of the ink tank 1*a*, the ink-impregnated member 12*a* comes into surface contact with the guard member 4*a*, so that the ink-impregnated member 12*a* is brought into contact with the first meniscus formation member 14*a*. At this time, the ink-impregnated member 12*a* does not receive a pressing force in the form of a point or a line from a rib, as in the existing ink tank. Therefore, the change in the density of the ink-impregnated member 12*a* is suppressed to a small extent, and the ink held in the ink-impregnated member 12*a* can be used up. Further, since there are the plurality of communication channels 28*a*, the air enters the ink-impregnated member 12*a* via these communication channels. Consequently, the ink held in the ink-impregnated member 12*a* can be uniformly used. The guard member 4*a* ensures the air flow channels, and each of the air chambers 30*a* to 32*a* requires only a thickness of, e.g., about 2 mm. Accordingly, the need for a wide air layer formed above the ink-impregnated member 12*a*, as in the existing ink tank, is obviated, and the ink tank can be made compact in comparison with the existing ink tank. Alternatively, the amount of ink to be filled into the tank can be increased by increasing the size of the ink-impregnated member 12*a*.

Figure 27:
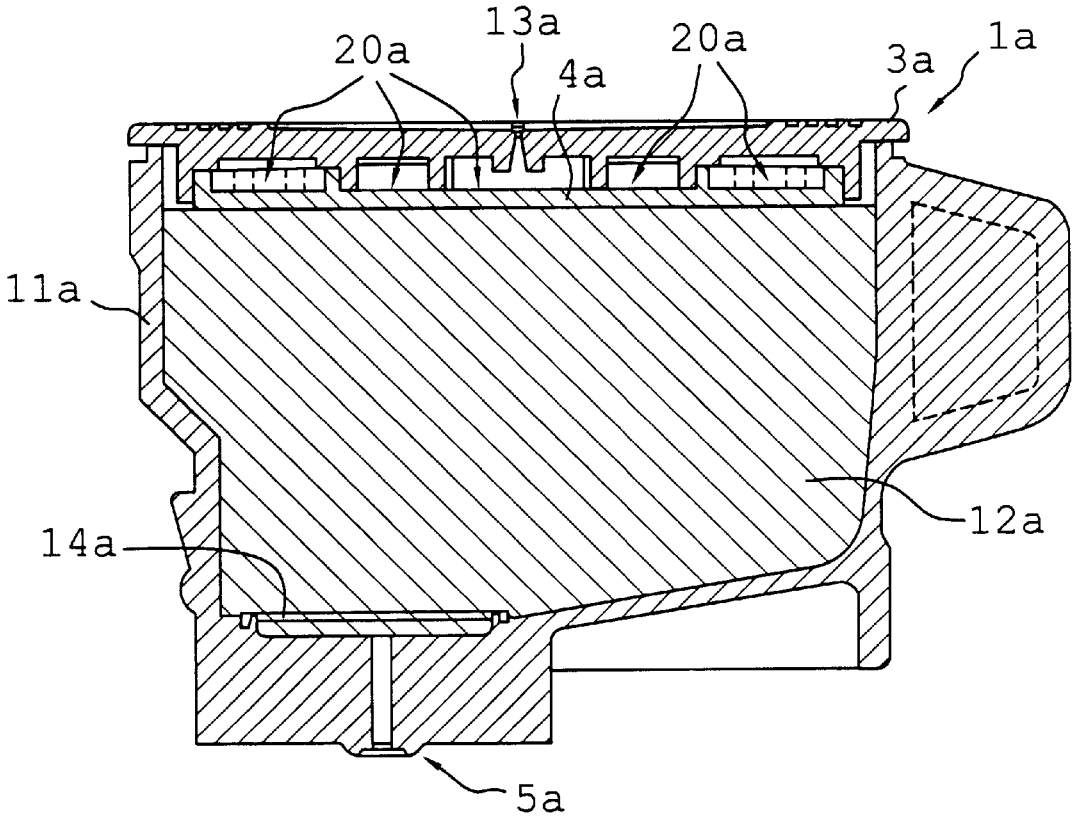
FIG. 27 is a cross-sectional view showing another embodiment of the ink tank in accordance with this invention.

FIG. 27 is a cross-sectional view showing another embodiment of the ink tank in accordance with the present invention. In the drawing, the elements which are the same as those shown in FIG. 22 are assigned the same reference numerals, and their explanations will be omitted here for brevity. Reference numeral 5*a* designates a print head. In this embodiment, the intermediate chamber 16*a* is not formed in the ink tank 1*a*, and the ink tank 1*a* includes only the main ink chamber 1*a*. Further, the ink tank is integrally connected to the print head 5*a*. Even in the case of the ink tank having one chamber, it is possible to prevent ink from leaking from the atmospheric communication hole 13*a* by attaching the guard member 4*a* to the ink tank in such a way that air flows to the main ink chamber 11*a* from the atmospheric communication chamber 13*a* via the air chambers.

The ink tank having two chambers as illustrated in FIG. 22*a* may be integrally connected to the print head 5*a*. Conversely, the ink tank having one chamber as shown in FIG. 27 may be formed so as to be separable from the print head 5*a*.

Although the example of the ink tank having the atmospheric communication hole 13*a* formed in the cover 3*a* is described in the previous embodiment, the housing 2*a* having the atmospheric communication hole 13*a* may be attached to the guard member 4*a* in an analogous fashion so as to constitute air chambers. This construction can be applied to any one of the tanks; e.g., a tank having one chamber, a tank having two chambers, a tank integrally attached to a print head, and a ink tank separable from a print head.

Figure 28:
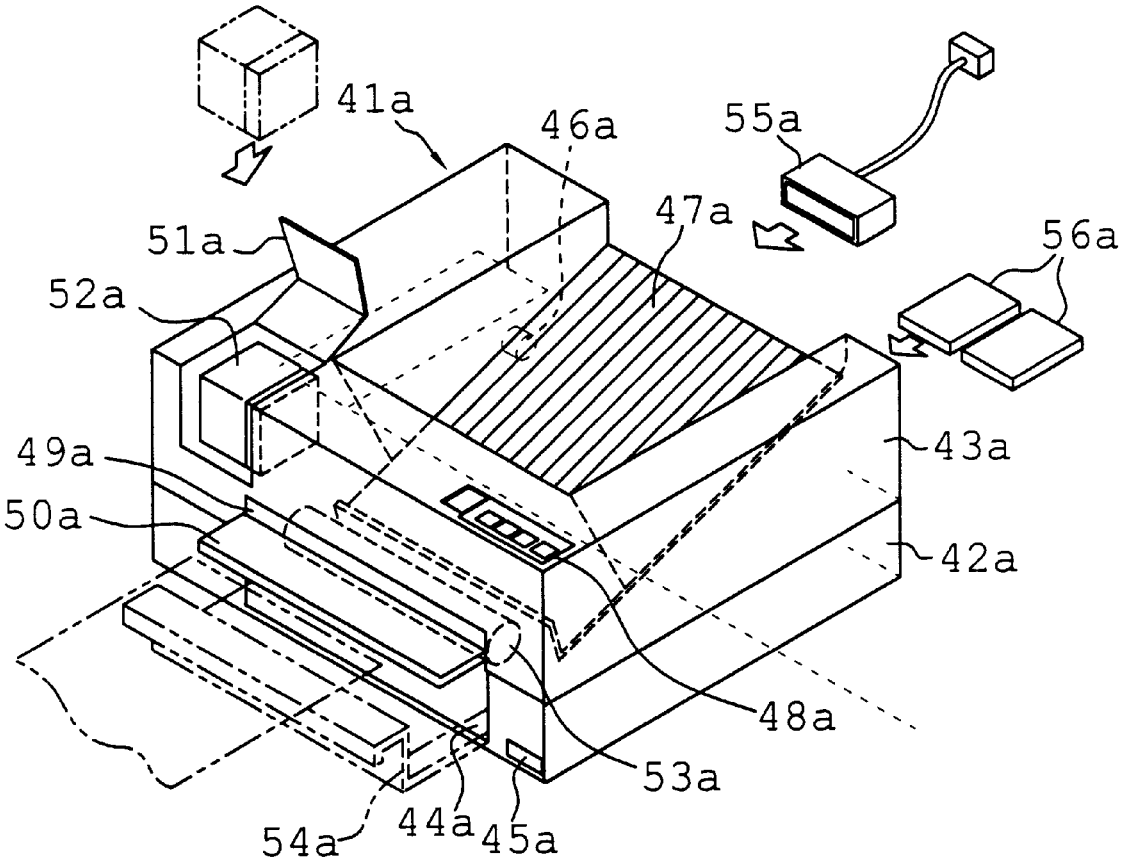
FIG. 28 is an external view showing one embodiment of an ink-jet recorder in accordance with this invention.

FIG. 28 is an external view of one example of an ink-jet recorder in accordance with the present invention. In the drawing, reference numeral 41*a* designates an ink-jet recorder; 42*a* designates a lower case; 43*a* designates an upper case; 44*a* designates a tray insert port; 45*a* designates dip switches; 46*a* designates a main switch; 47*a* designates a paper receiver; 48*a* designates a console panel; 49*a* designates a manual insert port; 50*a* designates a manual tray; 51*a* designates an ink tank insert cover; 52*a* designates an ink tank; 53*a* designates a paper feed roller; 54*a* designates a paper tray; 55*a* designates an interface cable; and 56*a* designates a memory card.

The housing of the ink-jet recorder 41*a* is substantially made up of the lower case 42*a* and the upper case 43*a*. Electrical circuits (not shown) and drive components (not shown) are housed in this housing. The tray insert port 44*a* is formed in the lower case 42*a*, and the paper tray 54*a* in which recording paper is loaded is inserted into this tray insert port 44*a*, whereby paper is loaded in the ink-jet recorder 44*a*.

The dip switches 45*a* and the main switch 46*a* are attached to the lower case 42*a*. The dip switches 45*a* are used in setting a part of the operation of the ink-jet recorder 41*a*, and the setting of features which are less frequently set is assigned to the dip switches. The dip switches 45*a* are covered with a cover when they are not in use. The main switch 46*a* is used in turning on/off the power of the ink-jet recorder 41*a*. Insert ports for an interface connector (not shown) or the memory card 56*a* are formed in the lower case 42*a*. The interface cable 55*a* is connected to the interface connector, whereby the ink-jet recorder exchanges data with respect to an external computer. The memory card 56*a* is used as expanded memory when the ink-jet recorder 41*a* operates. In some cases, fonts are stored in the memory card 56*a* and are used at the time of a recording operation.

The paper receiver 47*a* is formed in the upper case 43*a*, and recorded paper is output to this paper receiver 47*a*. The console panel 48*a* comprises input means which the user frequently uses to set a recording mode or instruct paper feed or paper output operations, or others, and display means for indicating a message output from the ink-jet recorder. Further, the manual insert port 49*a* and the manual tray 50*a* are formed in the upper case 43*a*, which enables the user to manually feed paper.

The ink tank insert cover 51*a* is formed in the upper case 43*a*. The ink tank 52*a* can be removed from or inserted into the inside of the upper case 43*a* by opening/closing the ink tank insert cover 51*a*. The ink tanks having the previously-described constructions may be used as the ink tank 52*a*. In the case of an ink tank which is separated from a print head, a communication path for a fluid is established between the ink tank 52*a* and the print head by inserting the ink tank 52*a* into the ink-jet recorder. In this case, the print head may be also designed so as to be removably attached to a carriage. In the case of an ink tank integrally attached to the print head, it is only required to fit the ink tank 52*a* to the carriage.

Paper is taken out of the paper tray 54*a* sheet by sheet and is fed by means of an internal conveyer system (not shown). Alternatively, paper is inserted from the manual insert port 49*a* and is fed along the circumference of the paper feed roller 53*a*. The print head travels in the direction orthogonal to the direction in which the paper is fed, whereby data are printed on the paper line by line. At this time, the main ink chamber moves associated with the travel of the print head, and the ink held in the ink-impregnated member undergoes acceleration or deceleration. Further, even before being attached to the print head, the ink tank 52*a* is subjected to force, such as vibration, acceleration/deceleration, or turnover, in every direction. For this reason, it is thought that the ink held in the ink-impregnated member will splash around the inside of the main ink chamber. However, by virtue of the construction of the foregoing ink tank, there is very few space for the ink to splash. Even if ink enters the communication channels which serve as air flow channels, the ink will be trapped in the air chambers. Therefore, the ink will not leak from the atmospheric communication hole. Further, in a case where a plurality of communication channels are formed in the ink tank, if ink chokes up some of the channels, the connection between the main ink chamber and the atmosphere is maintained by means of the remaining communication channels. As a result, the pressure of the main ink chamber can be maintained.

After the print head has finished printing a line on the paper, the paper is longitudinally fed to the next line by the paper feed roller 53*a*. Through the repetition of the foregoing operations, data are printed on the paper. The fully-printed paper is then output to the paper receiver 47*a* of the upper case 43*a*.

As is obvious from the foregoing description, in accordance with the present invention, the guard member is bonded to the interior surface of the ink tank which has the atmospheric communication hole. One or more air chambers are formed by means of the guard member, and air is introduced into the ink chamber through the air chambers. With this construction, in the event of physical shock or changes in the environmental conditions, ink can be prevented from leaking from the atmospheric communication hole. In comparison with the construction of an existing ink tank in which a rib is provided inside the tank to ensure space, the ink tank of the present invention ensures space by means of the guard member. Consequently, wider internal space of the ink tank main body can be used. Since the overall surface of the guard member presses the ink-impregnated member, the ink-impregnated member becomes less liable to cause a difference in its density. Accordingly, ink does not build up in the ink-impregnated member, thereby enabling efficient use of the ink. Further, in comparison with the communication plate that has a plurality of cavities and is attached to the outside of the ink tank, the guard member is attached to the inside of the ink tank, which in turn makes it possible to render the ink tank compact.

The ink-jet recorder equipped with the foregoing ink tank has the advantage of prevention of soiling due to splashing of ink during the course of printing operations, compactness, and inexpensive running costs.

What is claimed is:

1. An ink tank for use with a capillary vessel member that stores ink and connectable to a print head, comprising:

an outer wall member that houses the capillary vessel member, the outer wall member having a portion that defines an atmospheric communication hole, the outer wall member also having an inner surface defining a plurality of concave portions that communicate with the atmospheric communication hole; and a member disposed between the capillary vessel member and the inner surface of the outer wall member so as to define a space for air communication between the capillary vessel member and each of the plurality of concave portions in order to prevent ink of the capillary vessel member from entering the atmospheric communication hole.

2. A recording apparatus that includes the ink tank as claimed in claim 1.

3. The ink tank according to claim 1, wherein an area of the concave portions is approximately equal to half of an area of the inner surface of the outer wall member.

4. An ink tank connectable to a print head, comprising:

an outer wall member having a portion that defines an atmospheric communication hole, the outer wall member also having an inner surface defining a plurality of concave portions that communicate with the atmospheric communication hole;

a capillary vessel member that stores ink disposed in the outer wall member; and a member disposed between the capillary vessel member and the inner surface of the outer wall member so as to define a space for air communication between each of the plurality of concave portions and the capillary vessel member in order to prevent ink of the capillary vessel member from entering the atmospheric communication hole.

5. The ink tank according to claim 4, wherein an area of the concave portions is approximately equal to half of an area of the inner surface of the outer wall member.

6. An ink tank for supplying ink to a print head, comprising:

an outer wall member that reservoirs ink, the outer wall member defining a communication port to conduct the ink, and an atmospheric communication port communicating with an external atmosphere, the outer wall member having an inner surface defining a plurality of concave portions that communicate with the atmospheric communication hole;

a capillary vessel member disposed in the outer wall member and capable of accommodating the ink; and a member disposed between the capillary vessel member and the inner surface of the outer wall member so as to define a space for air communication between the capillary vessel member and each of the plurality of concave portions in order to prevent ink of the capillary vessel member from entering the atmospheric communication port.

7. The ink tank of claim 6, wherein the member contacts said capillary vessel member.

8. The ink tank of claim 6, wherein a compression degree of said capillary vessel member near said atmospheric communication port is not greater than a compression degree of said capillary vessel member near a center portion thereof.

9. The ink tank of claim 6, wherein the inner surface of the outer wall member that defines said plurality of concave portions is disposed opposite to an exterior surface of the outer wall member that communicates with the external atmosphere.

10. The ink tank of claim 6, wherein an area of said plurality of concave portions is substantially equal to an area of the wall of the outer wall member providing said atmospheric communication port.

11. The ink tank according to claim 6, wherein an area of the concave portions is approximately equal to half of an area of the inner surface of the outer wall member.

12. The ink tank of claim 6, wherein said atmospheric communication port is provided on an upper surface of said outer wall member and said plurality of concave portions are provided around said atmospheric communication port along a longitudinal direction of said outer wall member.

13. The ink tank of claim 12, wherein a shape of said plurality of concave portions is substantially rectangular.

14. The ink tank of claim 12, wherein the plurality of concave portions communicate with each other along the longitudinal direction of the outer wall member.

15. The ink tank of claim 12, wherein at least two concave portions of the plurality of concave portions extend in a direction orthogonal to the longitudinal direction of the outer wall member and at least one concave portion of the plurality of concave portions extends in the longitudinal direction of the outer wall member.

16. An ink tank for supplying ink to a print head, comprising:

a capillary vessel member capable of accommodating ink;

a lid defining an atmospheric communication port to communicate with an external atmosphere, the lid also defining a plurality of concave portions around said atmospheric communication port on a surface of the lid and a member spaced from the concave portions; and an ink chamber for holding said capillary vessel member therein, a communication port to conduct the ink is provided in a lower portion of the ink chamber, and said lid is mounted at the ink chamber in such a manner that the surface containing said plurality of concave portions is located inside of the ink chamber, wherein said atmospheric communication port is separated from said capillary vessel member by the external atmosphere in each of said plurality of concave portions, while the member of the lid contacts said capillary vessel member, the member defining a space for air communication between each of the plurality of concave portions and the capillary vessel member in order to prevent ink of the capillary vessel member from entering the atmospheric communication port.

17. The ink tank of claim 16, wherein a shape of said plurality of concave portions is substantially rectangular.

18. The ink tank of claim 16, wherein the plurality of concave portions communicate with each other along a longitudinal direction of the ink chamber.

19. The ink tank of claim 16, wherein at least two concave portions of the plurality of concave portions extend in a direction orthogonal to the longitudinal direction of the ink chamber and at least one concave portion of the plurality of concave portions extends in the longitudinal direction of the ink chamber.

20. The ink tank of claim 16, wherein said capillary vessel member is compressed only by the member of the lid.

21. The ink tank of claim 16, wherein a compression degree of said capillary vessel member near said atmospheric communication port is not greater than a compression degree of said capillary vessel member near a center portion thereof.

22. The ink tank according to claim 16, wherein an area of the concave portions is approximately equal to half of an area of the surface of the lid.

23. An ink tank for supplying ink to a print head, comprising:

an ink chamber having a wall and an interior, the ink chamber capable of reservoiring ink;

a communication port, provided at a portion of said ink chamber, to conduct the ink reservoired in said ink chamber;

a lid defining an atmospheric communication port on a surface of the lid, the atmospheric communication port communicating with an external atmosphere and supplying said external atmosphere to the interior of said ink chamber;

a capillary vessel member, stored within said ink chamber, capable of accommodating the ink; and a plurality of concave portions defined by the lid on a surface of the lid opposite to the surface defining said atmospheric communication port; and a member defined by the lid and spaced from the concave portions;

wherein said atmospheric communication port is separated from said capillary vessel member by the external atmosphere in each of said plurality of concave portions, the member defining a space for air communication between each of the plurality of concave portions and the capillary vessel member in order to prevent ink of the capillary vessel member from entering the atmospheric communication port.

24. The ink tank of claim 23, wherein said capillary vessel member is not compressed by the member of the lid.

25. The ink tank of claim 23, wherein said ink tank includes a meniscus forming member formed on said communication port, arranged in contact with said capillary vessel member, and in which a plurality of very small holes are formed.

26. The ink tank of claim 23, wherein said meniscus is made of a material selected from a group of materials including a mesh-shaped member and a porous body.

27. The ink tank of claim 23, wherein said meniscus has a shape selected from a group of shares including circular and rectangular.

28. The ink tank of claim 23, wherein said capillary vessel member is a porous material.

29. The ink tank of claim 23, wherein said capillary vessel member includes three-dimensionally branched filaments.

30. The ink tank of claim 23, wherein said capillary vessel member is a material spun in a three-dimensional shape.

31. The ink tank of claim 23, wherein said capillary vessel member is a bundled fiber material.

32. The ink tank according to claim 23, wherein an area of the concave portions is approximately equal to half of an area of the surface of the lid.

33. The ink tank of claim 23, wherein a compression degree of said capillary vessel member near said atmospheric communication port is not greater than a compression degree of said capillary vessel member near a center portion thereof.

34. The ink tank of claim 33, further comprising:

an intermediate ink chamber corresponding to a small chamber under a highly sealed condition; and a communication path communicating with said communication port of said ink chamber, said intermediate ink chamber, and said print head.

35. The ink tank of claim 23, wherein the lid in which said atmospheric communication hole is defined is a portion of the wall of the ink chamber.

36. The ink tank of claim 35, wherein said capillary vessel member is not compressed by the member of the lid.

37. The ink tank of claim 35, wherein a compression degree of said capillary vessel member near said atmospheric communication port is not greater than a compression degree of said capillary vessel member near a center portion thereof.

38. An ink tank for use with a capillary vessel member, comprising:

an outer wall member having an interior surface and housing the capillary vessel member;

a lid bonded to the outer wall member, the lid defining an atmospheric communication hole and a plurality of concave portions that communicate with the atmospheric communication hole, the lid having a member that defines a space for air communication between the capillary vessel member and the concave portions in order to prevent ink of the capillary vessel member from entering the atmospheric communication hole;

wherein air is introduced into said outer wall member from the atmospheric communication hole via said space.

39. The ink tank of claim 38, wherein the lid includes an upper portion that defines the atmospheric communication hole, and said member is bonded to the upper portion.

40. An ink-jet printer that includes said ink tank of claim 38.

41. The ink tank according to claim 38, wherein an area of the concave portions is approximately equal to half of an area of an inner surface of the lid.

42. The ink tank of claim 38, wherein partitions are integrally formed around the atmospheric communication hole on said lid and form said concave portions.

43. The ink tank of claim 42, wherein communication channels are formed and disposed in at least one of said partitions and said areas corresponding to said partitions.

* * * * *